US012805688B2

(12) United States Patent
Jang et al.

(10) Patent No.: US 12,805,688 B2
(45) Date of Patent: Nov. 24, 2026

(54) MOP MODULE OF CLEANER

(71) Applicant: LG Electronics Inc., Seoul (KR)

(72) Inventors: Jaewon Jang, Seoul (KR); Yeongjae Lee, Seoul (KR); Minwoo Lee, Seoul (KR); Aekyung Chae, Seoul (KR)

(73) Assignee: LG Electronics Inc., Seoul (KR)

( * ) Notice: Subject to any disclaimer, the term of this patent is extended or adjusted under 35 U.S.C. 154(b) by 171 days.

(21) Appl. No.: 18/293,201

(22) PCT Filed: Jul. 22, 2022

(86) PCT No.: PCT/KR2022/010760
§ 371 (c)(1),
(2) Date: Jan. 29, 2024

(87) PCT Pub. No.: WO2023/008836
PCT Pub. Date: Feb. 2, 2023

(65) Prior Publication Data

US 2025/0072697 A1 Mar. 6, 2025

Related U.S. Application Data

(60) Provisional application No. 63/203,568, filed on Jul. 27, 2021.

(30) Foreign Application Priority Data

Dec. 3, 2021 (KR) ..... 10-2021-0172188

(51) Int. Cl.
*A47L 11/40* (2006.01)
*A47L 11/282* (2006.01)

(52) U.S. Cl.
CPC ..... *A47L 11/4086* (2013.01); *A47L 11/282* (2013.01); *A47L 11/4038* (2013.01); *A47L 11/4083* (2013.01); *A47L 11/4088* (2013.01)

(58) Field of Classification Search
CPC ..... A47L 11/4086; A47L 11/282; A47L 11/4038; A47L 11/4083; A47L 11/4088
See application file for complete search history.

(56) References Cited

U.S. PATENT DOCUMENTS 6,031,969 A 2/2000 Burr et al.
7,640,626 B2 1/2010 Oh
(Continued)

FOREIGN PATENT DOCUMENTS

CN 101305893 11/2008
CN 103315684 9/2013
(Continued)

OTHER PUBLICATIONS

Extended European Search Report in European Appln. No. 22849811.9, mailed on Jun. 24, 2025, 9 pages.
(Continued)

*Primary Examiner* — Andrew A Horton
(74) *Attorney, Agent, or Firm* — Fish & Richardson P.C.

(57) ABSTRACT

A wet duster module of a cleaner includes a module housing, a water tank coupled to the module housing and storing water therein, and a steam generator which heats water supplied from the water tank, the steam generator including a water inlet through which water is introduced from the water tank and a moisture outlet through which heated moisture is discharged, in a state in which the duster is placed on a floor, a height from the floor to the water inlet is higher than a height from the floor to the moisture outlet, so that the drain generated inside the steam generator is not discharged to the outside and can be continuously heated.

20 Claims, 13 Drawing Sheets

(56) References Cited

U.S. PATENT DOCUMENTS

| | | | | |
|---|---|---|---|---|
| 7,921,507 | B2 | 4/2011 | Oh et al. | |
| 2005/0276586 | A1 | 12/2005 | Thweatt, Jr. | |
| 2006/0249186 | A1 | 11/2006 | Cohen et al. | |
| 2008/0134993 | A1 | 6/2008 | Tsen | |
| 2008/0282490 | A1* | 11/2008 | Oh | A47L 11/34 15/246.3 |
| 2009/0064448 | A1* | 3/2009 | Oh | A47L 11/4086 15/320 |
| 2014/0259515 | A1* | 9/2014 | Nuttall | A47L 11/4088 15/322 |
| 2018/0092502 | A1 | 4/2018 | Hansen et al. | |
| 2019/0328193 | A1 | 10/2019 | Yang et al. | |

FOREIGN PATENT DOCUMENTS

| | | | |
|---|---|---|---|
| CN | 103445730 | | 12/2013 |
| CN | 104068799 | | 10/2014 |
| CN | 110547735 | A | 12/2019 |
| CN | 212913101 | U | 4/2021 |
| EP | 2065639 | A2 | 6/2009 |
| GB | 2511102 | A | 8/2014 |
| JP | 2006-102052 | | 4/2006 |
| KR | 10-0738478 | B1 | 7/2007 |
| KR | 10-0766437 | B1 | 10/2007 |
| KR | 10-0813543 | B1 | 3/2008 |
| KR | 10-2008-0100979 | | 11/2008 |
| KR | 10-2009-0043379 | | 5/2009 |
| KR | 10-2011-0001124 | A | 1/2011 |
| KR | 101342567 | | 12/2013 |
| KR | 10-1408733 | B1 | 6/2014 |
| WO | 2003/092463 | A1 | 11/2003 |
| WO | 2008/007830 | A1 | 1/2008 |
| WO | 2009/148911 | A1 | 12/2009 |

OTHER PUBLICATIONS

Extended European Search Report in European Appln. No. 22849812.7, mailed on Jun. 18, 2025, 9 pages.

Office Action in Australian Appin. No. 2022316717, mailed on Feb. 5, 2025, 5 pages.

Office Action in Taiwanese Appln. No. 111127624, mailed on Aug. 8, 2023, 26 pages (with English translation).

Office Action in Chinese Appln. No. 202280051977.9, mailed on May 22, 2026, 13 pages (with English translation).

Office Action in U.S. Appl. No. 18/293,224, mailed on Feb. 11, 2026, 25 pages.

* cited by examiner

MOP MODULE OF CLEANER

CROSS-REFERENCE TO RELATED APPLICATIONS

This application is a National Stage application under 35 U.S.C. § 371 of International Application No. PCT/KR2022/010760, filed on Jul. 22, 2022, which claims the benefit of Korean Application No. 10-2021-0172188, filed on Dec. 3, 2021, and U.S. Provisional Application No. 63/203,568, filed on Jul. 27, 2021. The disclosures of the prior applications are incorporated by reference in their entirety.

BACKGROUND OF THE INVENTION

Field of the Invention

The present invention relates to a cleaner, and more particularly, to a wet duster module of the cleaner for sucking or wiping dust or foreign substance in an area to be cleaned by discharging water to a duster.

Description of the Related Art

A cleaner is a device that performs cleaning by sucking or wiping dust or foreign substance in an area to be cleaned.

Such a cleaner may be divided into a manual cleaner in which a user directly moves the cleaner to perform cleaning, and an automatic cleaner which performs cleaning while driving by itself.

In addition, the manual cleaner may be classified into a canister-type cleaner, an upright-type cleaner, a handy-type cleaner, a stick-type cleaner and the like, depending on the shape of the cleaner.

There are two main types of floor cleaning, dry cleaning and wet cleaning. Dry cleaning is a method of cleaning by sweeping or sucking dust, and a conventional vacuum cleaner corresponds to this. Wet cleaning is a method of cleaning by wiping off dust with a wet duster.

Conventionally, a dry-only cleaner was used for dry cleaning, and a wet-only cleaner was used for wet cleaning. However, there was the inconvenience of having to purchase two types of cleaners in order to clean various types of floors. In order to solve the above problems, a method for equipping a main body, a dry cleaning module and a wet cleaning module, mounting the dry cleaning module on the main body for dry cleaning, and mounting the wet cleaning module (wet duster module) on the main body for wet cleaning was researched.

However, in wet cleaning, if foreign substances are sticked to the floor, foreign substances may still remain even if the floor is wiped by rotating the duster that has absorbed water.

In addition, when microorganisms and the like are propagated on the floor, there is a limitation in that the microorganisms cannot be completely sterilized even if the floor is wiped by rotating the duster that has absorbed water.

In order to solve this problem, a method of heating water through a heater and supplying hot water or steam to the duster can be considered.

In this case, a steam duster module includes a water tank for storing water, a heater for heating water to generate steam, and a duster for wiping the floor by receiving water or steam. Here, it is preferable that each component is configured as one assembly in order to facilitate replacement. For example, when a water tank or a heater is disposed on a main body, there is a problem in that cleaning is inconvenient due to the weight of the water tank or heater as an unnecessary component during dry cleaning. Therefore, in terms of ease of cleaning, module replacement, or space utilization, it is preferable that the water tank or heater be disposed on the steam wet duster module rather than the cleaner body.

U.S. Pat. No. 9,420,933B2 (Aug. 23, 2016) discloses a heater used in a steam wet duster cleaner.

The steam wet duster cleaner has a configuration to receive water from a water tank, generate steam through a steam generator, and supply the water to a cleaning pad.

Here, the steam generator is configured to heat water in a stored state through a heater, and to discharge steam that is heated and flows upward through a discharge port provided on an upper side of the steam generator to a cleaning pad.

In addition, Korean Patent No. 1609444B1 (Mar. 30, 2016) discloses a water cleaner equipped with a steam generating means.

In the water cleaner, both a water supply port and a steam discharge port are disposed on the upper side of the steam generating means, and the water supply port and the steam discharge port are connected to each other by a U-shaped pipe.

As such, in the conventional steam generator, a discharge port for discharging steam is generally disposed on the upper side of the steam generator.

However, even when steam is supplied with a duster, the steam heated by the heater has a relatively low density compared to water and rises upward. Thus, there is a limitation in that water, not steam, is mainly supplied to the duster disposed below the heater.

In addition, while the wet duster module moves along the bottom, the heater shakes, so that the water flowing inside the heater may not be sufficiently heated and discharged with the duster.

SUMMARY OF THE INVENTION

The present invention was created to improve the problems of the conventional wet duster module of a cleaner as described above, and it is an object of the present invention to provide a wet duster module of a cleaner that increases the sterilization and foreign substance removal effect by supplying high-temperature water or steam to the duster.

Another object of the present invention is to provide a wet duster module of a cleaner capable of continuously heating the drain generated inside a steam generator without being discharged to an outside.

Another object of the present invention is to provide a wet duster module of a cleaner capable of maintaining a supply amount of water or steam by maintaining a flow direction of moisture even if the steam generator shakes during cleaning.

Another object of the present invention is to provide a wet duster module of a cleaner capable of heating the water introduced into a steam generator to a target temperature while the water flows.

Another object of the present invention is to provide a wet duster module of a cleaner capable of controlling the temperature and phase of moisture supplied to the duster according to selection.

In order to achieve the above object, a wet duster module of a cleaner which wipes and cleans foreign substance on a floor, may include a module housing; a water tank coupled to the module housing and storing water therein; at least one rotation cleaning unit disposed on a lower side of the module housing and to which a duster is able to be coupled; and a steam generator which heats water supplied from the water tank.

In this case, the steam generator may include a water inlet through which water is introduced from the water tank; and a moisture outlet through which heated moisture is discharged, in a state in which the duster is placed on a floor, a height from the floor to the water inlet may be higher than a height from the floor to the moisture outlet.

In addition, a shortest distance from the rotation cleaning unit to the water inlet may be greater than a shortest distance from the rotation cleaning unit to the moisture outlet.

The steam generator may include a heating chamber in which the water inlet and the moisture outlet are formed, and the water flows along a bottom thereof, in a state where the duster is placed on the floor, the bottom of the heating chamber may be inclined at a predetermined angle with the floor.

In addition, in a state in which the duster is placed on the floor, the bottom of the heating chamber may be inclined at a predetermined angle with a virtual extension surface of the rotation cleaning unit in a form of a disk.

The steam generator may include a heating chamber including a flow path through which moisture flows therein; a heater disposed on a lower side of the heating chamber and supplying heat to the heating chamber; a lower cover disposed on a lower side of the heater and covering the heater; a sealer disposed on an upper side of the heating chamber and sealing the upper side of the heating chamber; and an upper cover disposed on an upper side of the sealer and covering the sealer.

The heating chamber may include a chamber body; at least one flow guide wall protruding from an inside of the chamber body; a flow delay protrusion protruding from one end of the flow guide wall; and a partition wall protruding from a bottom of the chamber body in a front-rear direction to separate an inner space of the chamber body In this case, the flow guide wall may be formed to be inclined at a predetermined angle from a side wall of the chamber body.

In addition, the flow guide wall may be formed to be inclined at a predetermined angle from the partition wall.

In this case, in the heating chamber, the moisture may flow between the partition wall and the flow guide wall.

Meanwhile, the flow guide wall may include one end at which a flow delay protrusion is protruded and extended and the other end connected to a side wall of the chamber body, the one end may be disposed closer to the floor than the other end, an upper end of the flow delay protrusion may be disposed farther from the floor than the other end.

Meanwhile, the chamber body may include a first chamber in which the moisture flowing therein is heated, and a second chamber which is separated from the first chamber through a partition wall and in which the moisture flowing therein is heated independently of the first chamber.

In this case, a temperature inside the first chamber and a temperature inside the second chamber may be different from each other.

In addition, a phase of the moisture discharged from the first chamber and a phase of the moisture discharged from the second chamber may be different from each other.

The wet duster module of a cleaner according to the present invention may include a diffuser including at least one nozzle and supplying the moisture discharged from the steam generator to the duster through the nozzle.

The diffuser may include a diffuser body including a diffusion flow path through which the moisture is able to flow; and a connection pipe provided in the diffuser body and coupled to the moisture outlet of the steam generator.

In one embodiment, the diffuser body may be formed in an annular shape.

In another embodiment, the diffuser body may be formed in an arc shape.

As described above, according to the wet duster module of a cleaner according to the present invention, there is an effect that can increase the sterilization and foreign substance removal effect by supplying high-temperature water or steam to the duster through a heater.

In addition, since the water inlet is disposed higher than the moisture outlet, the drain generated inside the steam generator is not discharged to the outside, and can be continuously heated.

In addition, since the flow guide wall is formed in the heating chamber, even if the steam generator is shaken, the flow direction of moisture can be maintained so that the supply amount of water or steam can be maintained.

In addition, the flow guide wall and the flow delay protrusion are formed in the heating chamber, so that water introduced into the steam generator can be heated to a target temperature while flowing.

In addition, the present invention effectively provides a wet duster module of a cleaner that can measure a temperature through the temperature detector and control the heater to adjust the temperature and phase of moisture supplied to the duster according to selection.

In addition, the partition wall is formed in the heating chamber to separate the left and right chambers, thereby controlling the temperature and phase of moisture discharged from each of the left and right chambers.

DETAILED DESCRIPTION OF THE INVENTION

Figure 1:
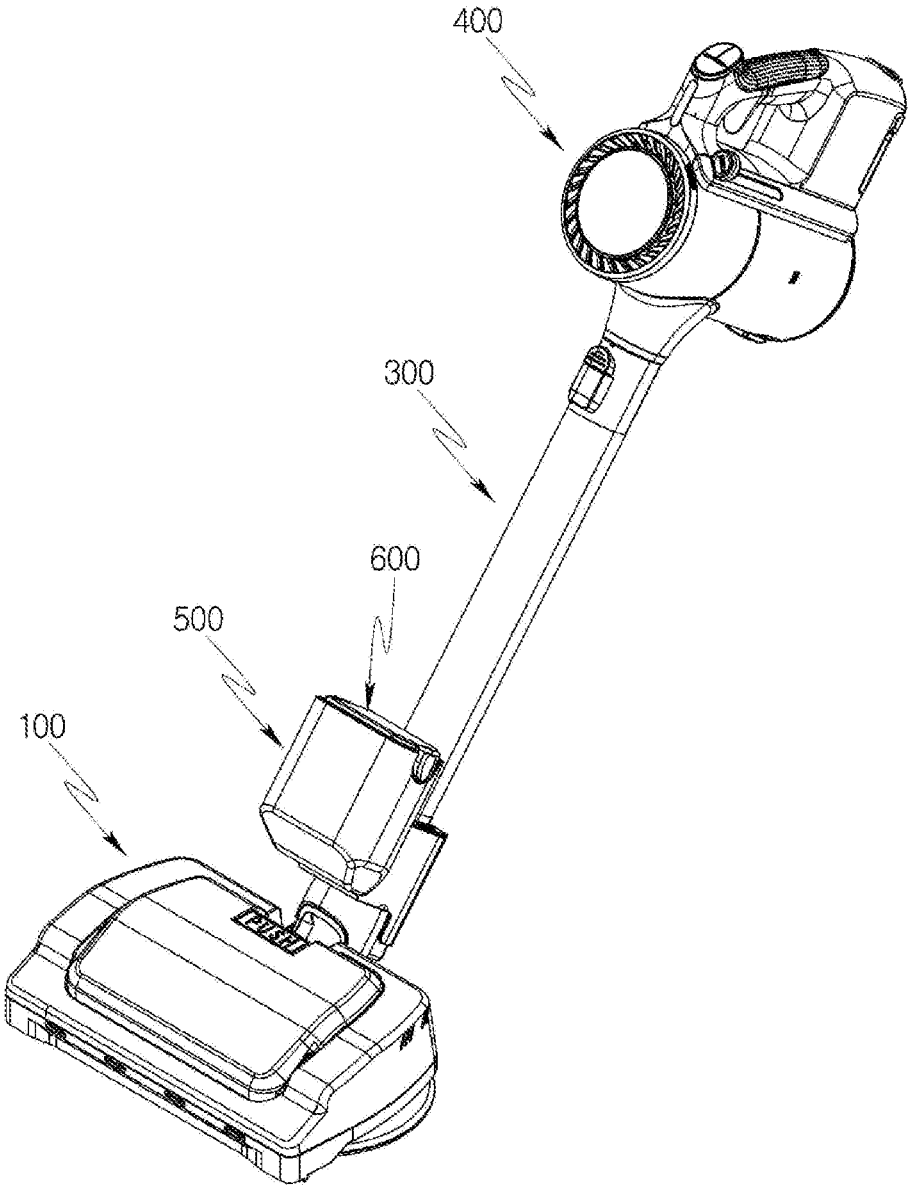
FIG. 1 is a perspective view of a cleaner according to an embodiment of the present invention.

Hereinafter, preferred embodiments of the present invention will be described in detail with reference to the accompanying drawings.

Since the present invention can have various changes and can have various embodiments, specific embodiments are illustrated in the drawings and will be described in detail in the detailed description. This is not intended to limit the present invention to specific embodiments, and should be construed to include all modifications, equivalents, and substitutes included in the spirit and scope of the present invention.

In describing the present invention, terms such as first and second may be used to describe various components, but the components may not be limited by the terms. The above terms are only for the purpose of distinguishing one component from another component. For example, without departing from the scope of the present invention, a first component may be referred to as a second component, and similarly, a second component may also be referred to as a first component.

The term "and/or" may include a combination of a plurality of related listed items or any of a plurality of related listed items.

When a component is referred to as being "connected" or "contacted" to another component, it may be directly connected or contacted to the other component, but it can be understood that other components may exist in between. On the other hand, when a component is referred to as being "directly connected" or "directly contacted" to another component, it may be understood that another component does not exist in the middle.

The terms used in the present application are only used to describe specific embodiments, and are not intended to limit the present invention. The singular expression may include the plural expression unless the context clearly dictates otherwise.

In the present application, terms such as "comprise" or "have" are intended to designate that a feature, number, step, operation, component, part, or combination thereof described in the specification exists, and it may be understood that it does not preclude the possibility of addition or existence of one or more other features, numbers, steps, operations, components, parts, or combinations thereof.

Unless defined otherwise, all terms used herein, including technical or scientific terms, may have the same meaning as commonly understood by one of ordinary skill in the art to which this invention belongs. Terms such as those defined in a commonly used dictionary may be interpreted as having a meaning consistent with the meaning in the context of the related art, and unless explicitly defined in the present application, it may not be interpreted in an idealistic or overly formal sense.

In addition, the following embodiments are provided to more completely explain to those of ordinary skill in the art, and the shapes and sizes of components in the drawings may be exaggerated for clearer explanation.

Figure 2:
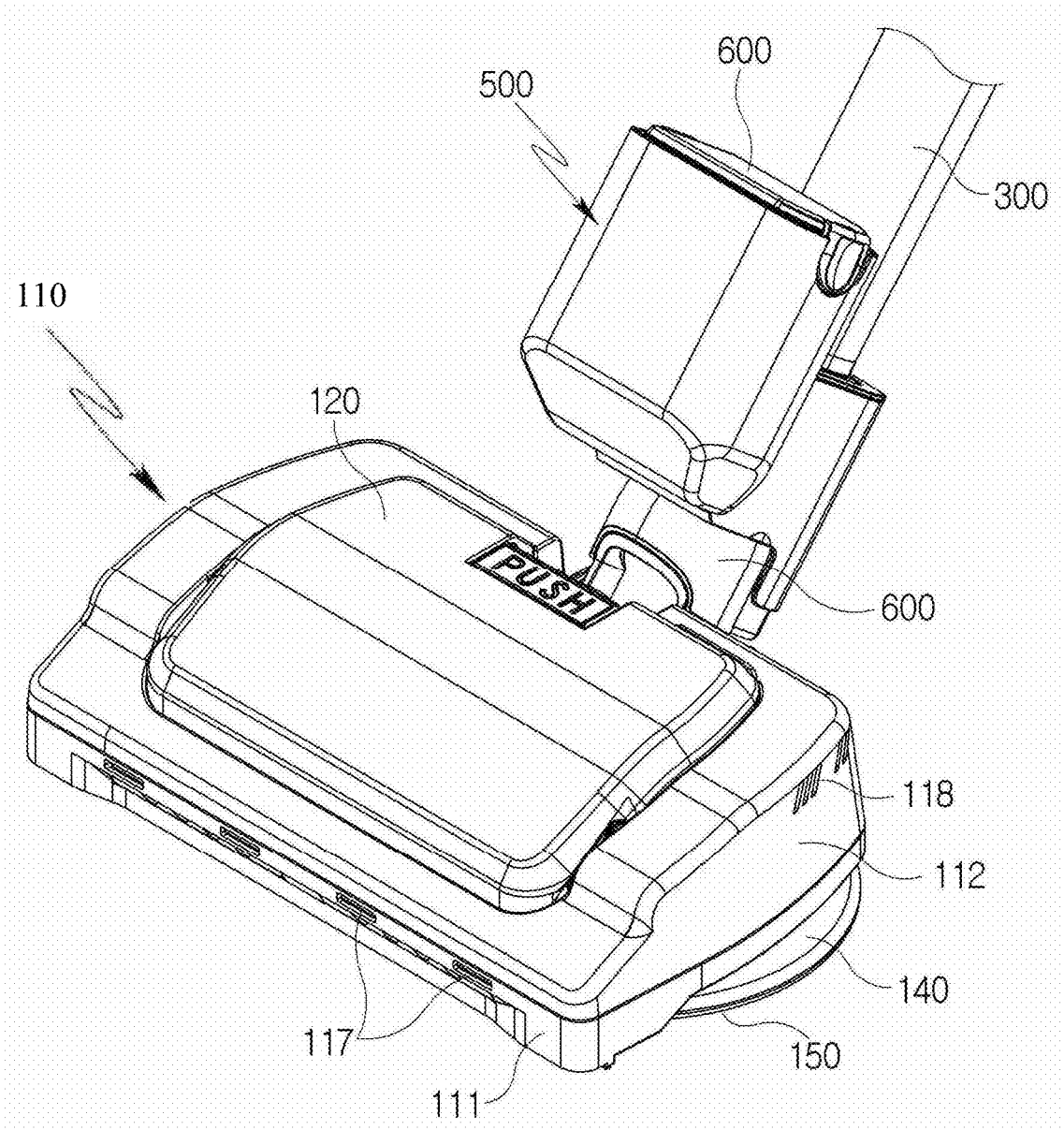
FIG. 2 is a combined perspective view for explaining a wet duster module according to an embodiment of the present invention.
Figure 3:
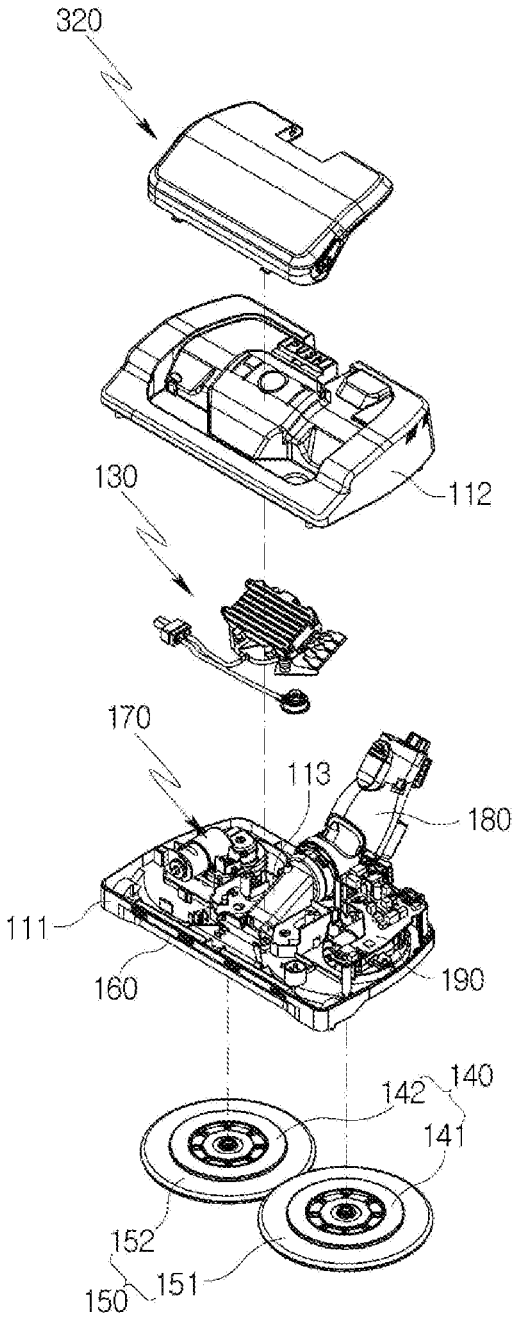
FIG. 3 is an exploded perspective view of FIG. 2.
Figure 4:
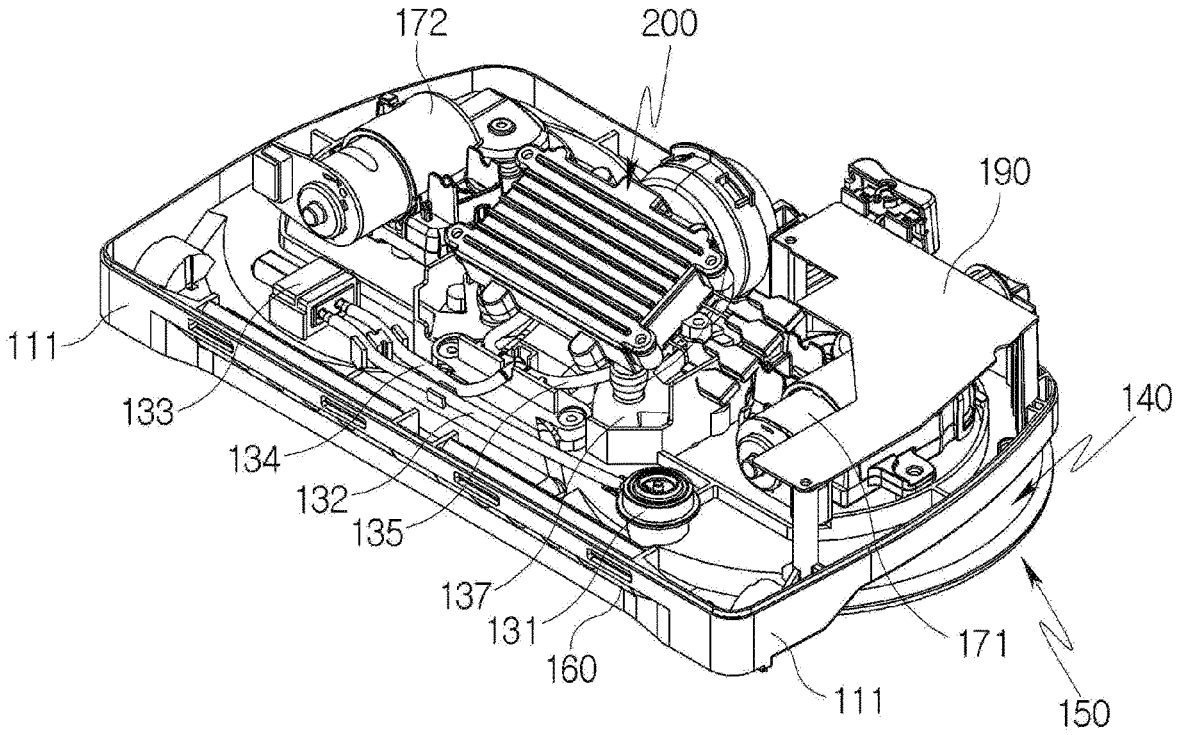
FIG. 4 is a perspective view of a state in which an upper housing is removed from a wet duster module according to an embodiment of the present invention.
Figure 5:
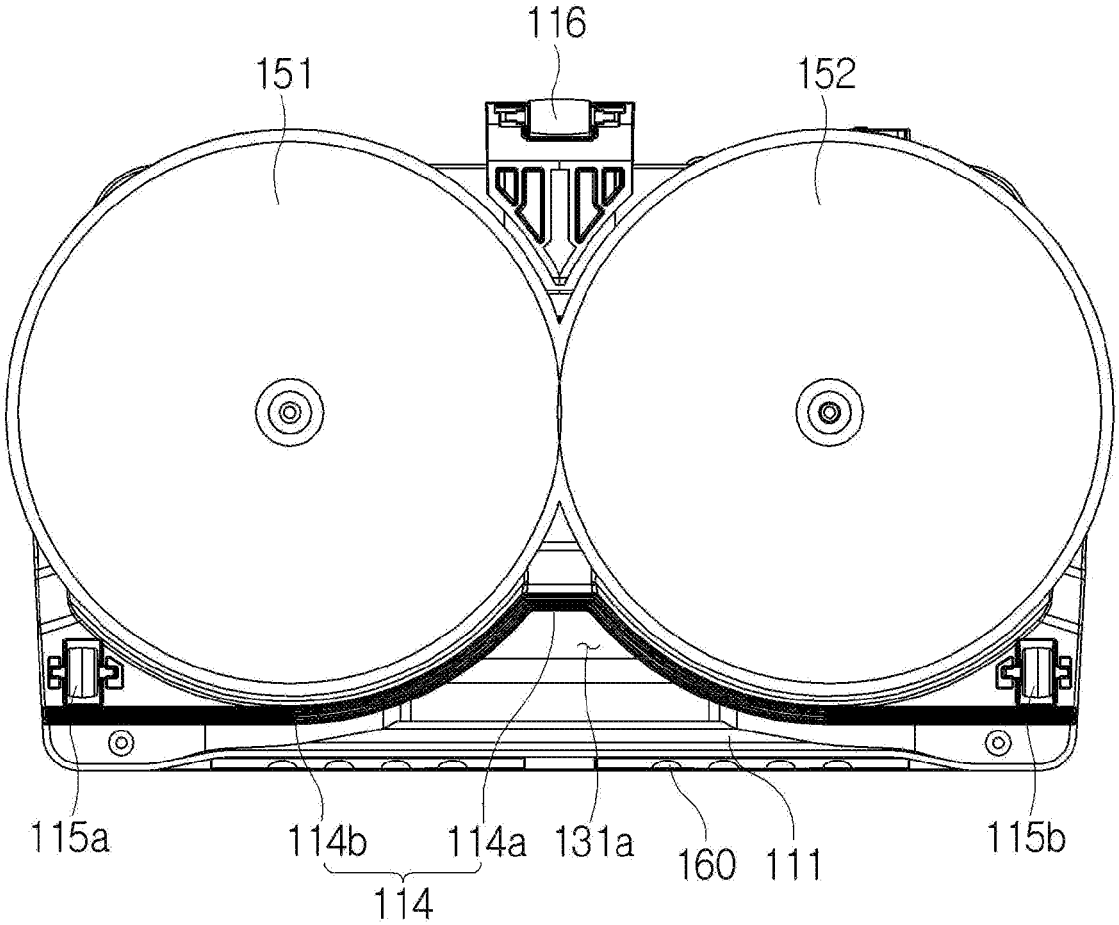
FIG. 5 is a bottom view of FIG. 4.
Figure 6:
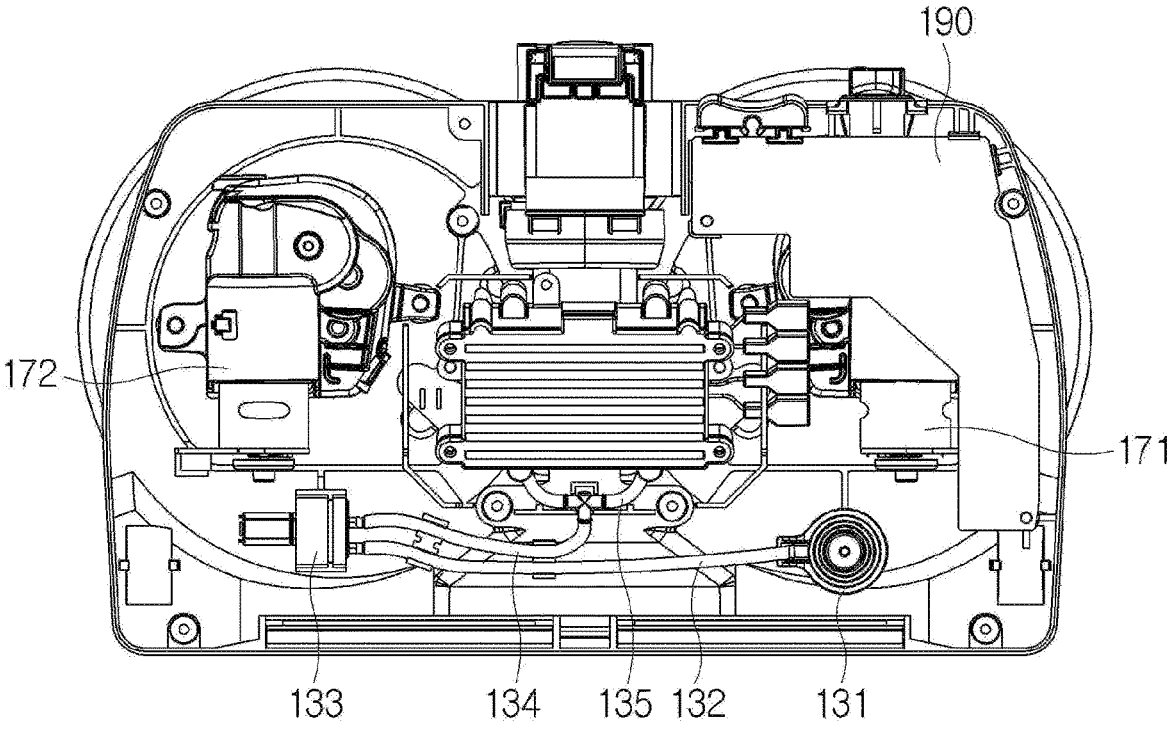
FIG. 6 is a plan view of FIG. 4.
Figure 7:
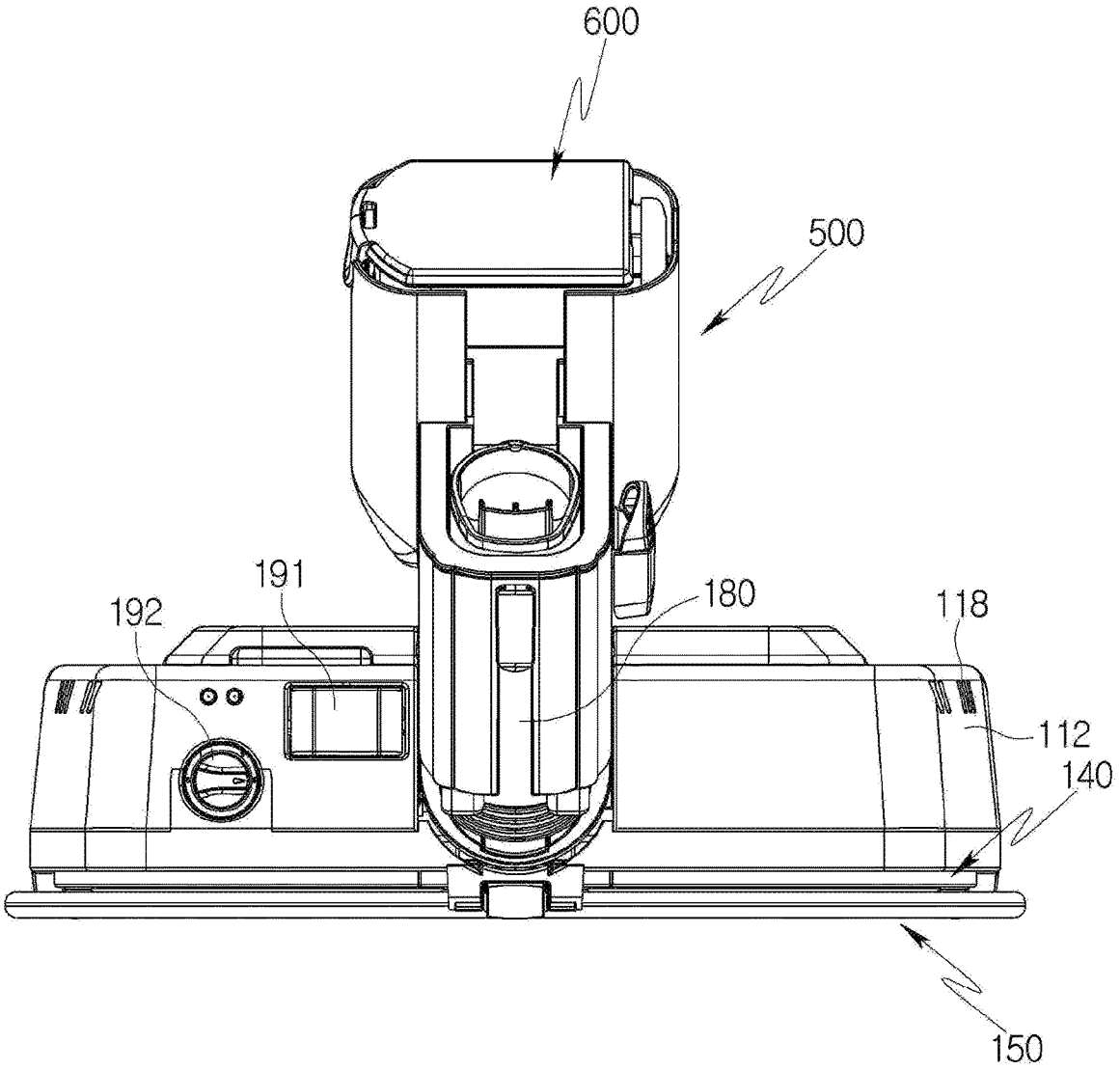
FIG. 7 is a rear view as viewed from the rear side of a wet duster module according to an embodiment of the present invention.
Figure 8:
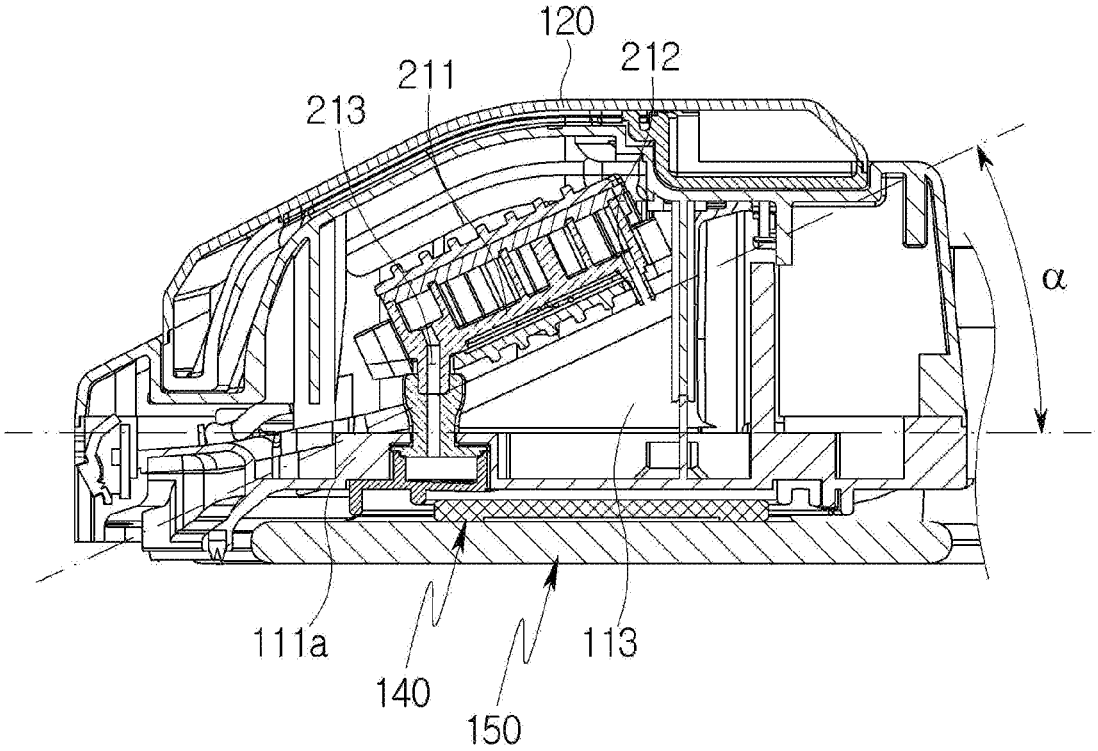
FIG. 8 is a cross-sectional view of a wet duster module according to an embodiment of the present invention.

FIG. 1 illustrates a perspective view of a cleaner according to an embodiment of the present invention, FIGS. 2 and 3 illustrate a combined perspective view and an exploded perspective view for explaining a wet duster module according to an embodiment of the present invention, FIGS. 4 to 6 illustrate views showing a state in which an upper housing is removed from a wet duster module according to an embodiment of the present invention. FIG. 8 illustrates a cross-sectional view of a wet duster module according to an embodiment of the present invention.

As used herein, the term "floor" may be understood to mean a floor surface of a living room or bedroom, as well as a cleaning surface such as a carpet.

Referring to FIGS. 1 to 8, a cleaner 1 according to an embodiment of the present invention includes a cleaner body 400 having a suction motor for generating a suction force, and a wet duster module 100 that is connected to the cleaner body 400 and sucks air and foreign substances from a floor to wipe and clean the floor, and an extension pipe 300 that connects the cleaner body 400 and the wet duster module 100.

The wet duster module 100 according to an embodiment of the present invention may include a module housing 110 and a connection pipe 180 movably connected to the module housing 110.

The wet duster module 100 of this embodiment may be used in connection with, for example, a handy type cleaner or a canister type cleaner.

That is, the wet duster module 100 may be detachably connected to the cleaner body 400 or the extension pipe 300. Accordingly, as the cleaner body 400 or the extension pipe 300 is connected, a user can clean the floor using the wet duster module 100. In this case, the cleaner body 400 to which the wet duster module 100 is connected can separate dust in the air in a multi-cyclone method.

The wet duster module 100 may operate by receiving power from the cleaner body 400.

Since the cleaner body 400 to which the wet duster module 100 is connected includes a suction motor (not shown), the suction force generated by the suction motor (not shown) acts on the wet duster module 100 so that the wet duster module 100 can suck the foreign substances and air of the floor.

Therefore, in this embodiment, the wet duster module 100 may serve to guide the air and foreign substances on the floor to the cleaner body 400.

The connection pipe 180 is connected to a rear central part of the module housing 110, and may guide the sucked air to the cleaner 1, but is not limited thereto.

If a direction is defined in this embodiment for better understanding, a part to which the connection pipe 180 is connected in the wet duster module 100 may be referred to as a back (rear) of the wet duster module 100, and the opposite side of the connection pipe 180 may be referred to as a head (front) of the wet duster module 100. In addition, a direction connecting the front and rear may be referred to as a front-rear direction.

In addition, based on when a suction port 113*a* is viewed from the connection pipe 180, the left side of the flow path forming unit 113 may be referred to as the left side (left) of the wet duster module 100, and the right side of the flow path forming unit 113 may be referred to as the right side (right) of the wet duster module 100. In addition, a direction connecting the left and right sides may be referred to as a left-right direction. The left-right direction may refer to a direction perpendicular to the front-rear direction to each other on a horizontal plane.

In addition, based on the state in which the wet duster module 100 is placed on the floor, that is, the duster 150 is placed on the floor to wipe the floor, the direction closer to the floor may be a lower side or downward, the direction away from the floor may be referred to as upper side or upward.

The wet duster module 100 may further include a rotation cleaning unit 140 that is rotatably provided on the lower side of the module housing 110.

For example, the rotation cleaning unit 140 may be provided as a pair and arranged in the left-right direction. In this case, the pair of rotation cleaning units 140 may be rotated independently. As an example, the rotation cleaning unit 140 may include a first rotation cleaning unit 141 and a second rotation cleaning unit 142.

The rotation cleaning unit 140 may be combined with the duster 150. The duster 150 may be formed in the form of a disk, for example. The duster 150 may include a first duster 151 and a second duster 152.

In a state in which the duster 150 is placed on the floor, the duster 150 is in close contact with the floor due to the load of the wet duster module 100, and thus the frictional force between the duster 150 and the floor is increased.

The module housing 110 may form an outer appearance of the wet duster module 100, and a suction port 113*a* for sucking air may be formed. The suction port 113*a* may be formed, for example, at the front end of the lower surface of the module housing 110. The suction port 113*a* may extend in the left-right direction from the module housing 110.

The module housing 110 may include a lower housing 111 and an upper housing 112 coupled to an upper side of the lower housing 111.

The rotation cleaning unit 140 may be mounted on the lower housing 111, and the lower housing 111 may form the outer appearance of the wet duster module 100.

The lower housing 111 may include a bottom 111*a* to which the rotation cleaning unit 140 is coupled. In this case, the lower surface of the bottom 111*a* is disposed to face the floor in a state where the wet duster module 100 is placed on the floor, and a moisture supply unit 130, a steam generator 200 and a duster drive motor 170 may be provided on the upper surface of the bottom 111*a*.

The suction port 113*a* may be formed in the lower housing 111. Specifically, the suction port 113*a* may be formed on the bottom 111*a* of the lower housing 111. The suction port 113*a* refers to a space into which air containing dust may be introduced. With this configuration, when the suction motor (not shown) of the cleaner body 400 is operated, dust and air existing around the floor can be sucked into the flow path of the wet duster module 100 through the suction port 113*a*.

The lower housing 111 may be provided with a board installation unit on which a printed circuit board 190 for controlling the duster drive motor 170 is installed. For example, the board installation unit may be formed in the form of a hook extending upward from the lower housing 111.

Although not limited, the board installation unit may be positioned at one side of the flow path forming unit 113 in the lower housing 111. For example, the printed circuit board 190 may be disposed adjacent to a first manipulator 191 and a second manipulator 192. Accordingly, a switch installed on the printed circuit board 190 can detect the manipulation of the first manipulator 191 and the second manipulator 192.

A nozzle hole (not shown) through which a diffuser 137 passes may be formed in the lower housing 111. Water or steam (water vapor) that has passed through the steam generator 200 and the diffuser 137 through the nozzle hole (not shown) may be supplied to the duster 150.

Meanwhile, a light emitting module 160 may be provided in the lower housing 111. Specifically, the light emitting module 160 may be provided on the front of the lower housing 111.

The upper housing 112 may cover the upper side of the lower housing 111 and form the outer appearance of the wet duster module 100 of the present invention.

In addition, the module housing 110 may further include the flow path forming unit 113 communicating with the suction port 113*a* to form a flow path for guiding the air introduced from the suction port 113*a* to the cleaner body 400.

The flow path forming unit 113 may be coupled to an upper central part of the lower housing 111, and an end thereof may be connected to the connection pipe 180.

Accordingly, since the suction port 113*a* can extend in a substantially straight line in the front-rear direction by the arrangement of the flow path forming unit 113, the length of the suction port 113*a* can be minimized, and the flow path loss in the wet duster module 100 can be minimized.

The front part of the flow path forming unit 113 may cover the upper side of the suction port 113*a*. The flow path forming unit 113 may be disposed to be inclined upward from the front end toward the rear. That is, the upper surface of the flow path forming unit 113 may be inclined at a predetermined angle to the floor. In addition, the upper surface of the flow path forming unit 113 may be inclined at a predetermined angle with the bottom 111*a* of the lower housing 111.

Accordingly, the height of the front part of the flow path forming unit 113 may be lower than that of the rear part.

According to this embodiment, since the height of the front part of the flow path forming unit 113 is low, there is an advantage in that the height of the front part among the overall height of the wet duster module 100 can be reduced. The lower the height of the wet duster module 100, the higher the possibility that it can be cleaned by being drawn into a narrow space under the furniture or chair.

Meanwhile, in the present embodiment, the steam generator 200 may be disposed on the upper side of the flow path forming unit 113. With such a configuration, the steam generator 200 may be stably supported while being disposed at a predetermined angle with the floor.

A blocker 114 is disposed on the lower side (the lower surface of the bottom 111*a*) of the lower housing 111. The blocker 114 may block a front space in which the suction port 113*a* is disposed and a rear space in which the duster 150 is disposed, thereby preventing the moisture emitted from the duster 150 from being diffused into the suction port 113*a*. For example, the blocker 114 may include a central part 114*a* and an extension part 114*b*. In this case, a pair of extension parts 114*b* may be symmetrically connected to both ends with respect to the central part 114*a*. In addition, the central part 114*a* may be disposed at the rear of the suction port 113*a* to block the flow of moisture toward the suction port 113*a*. In addition, the extension part 114*b* may be provided in an arc shape to surround the duster 150 in a circular shape.

A plurality of rollers for smooth movement of the wet duster module 100 may be provided on the lower side of the bottom 111*a* of the lower housing 111.

For example, a front roller 115 may be positioned in front of the duster 150 in the lower housing 111. The front roller 115 may include a first roller 115*a* and a second roller 115*b*. The first roller 115*a* and the second roller 115*b* may be disposed to be spaced apart from each other in the left-right direction.

The first roller 115*a* and the second roller 115*b* may be rotatably connected to a shaft, respectively. The shaft may be fixed to the lower side of the lower housing 111 in a state in which it extends in the left-right direction.

The distance between the shaft and the front end of the lower housing 111 is longer than the minimum distance between the duster 150 and the front end of the lower housing 111.

For example, at least a portion of the rotation cleaning unit 140 may be positioned between the shaft of the first roller 115*a* and the shaft of the second roller 115*b*.

According to this arrangement, the rotation cleaning unit 140 can be positioned as close as possible to the suction port 113*a*, and the area cleaned by the rotation cleaning unit 140 among the floor on which the wet duster module 100 is located is increased, and thus, the cleaning performance of the floor can be improved.

In this embodiment, since the first roller 115*a* and the second roller 115*b* are coupled to the lower side of the lower housing 111, the mobility of the wet duster module 100 can be improved.

The lower housing 111 may further include a third roller 116. Accordingly, the first roller 115*a* and the second roller 115*b* may support the wet duster module 100 together with the third roller 116 at three points. In this case, the third roller 116 may be positioned at the rear of the duster 150 so as not to interfere with the duster 150.

A cooling air inlet 117 may be formed in the lower housing 111. External air may be introduced into the module housing 110 through the cooling air inlet 117. In addition, the cooling air inlet 117 may be formed in the front sidewall of the lower housing 111. With such a configuration, when the wet duster module 100 moves forward by the user's operation, the amount of air inflow can be increased.

A cooling air outlet 118 may be formed in the upper housing 112. The air inside the module housing 110 may be discharged to the outside through the cooling air outlet 118. In addition, the cooling air outlet 118 may be formed on both sidewalls of the upper housing 112. With such a configuration, the air introduced through the cooling air inlet 117 can be induced to pass through the duster drive motor 170 in the process of flowing to the cooling air outlet 118, and there is an advantage of preventing the duster drive motor 170 from being overheated.

In addition, based on the state in which the lower housing 111 is placed on the floor, the cooling air outlet 118 may be disposed farther from the ground than the cooling air inlet 117. With such a configuration, the heated air inside the module housing 110 rises and can be effectively discharged to the cooling air outlet 118.

The wet duster module 100 may further include a water tank 120 to supply moisture to the duster 150.

The water tank 120 may be detachably connected to the module housing 110. Specifically, the water tank 120 may be coupled to the upper side of the upper housing 112. For example, the water tank 120 may be mounted on a water tank seat formed on the upper surface of the upper housing 112.

Also, the water tank 120 may be disposed on the upper side of the steam generator 200. Specifically, the water tank 120 is disposed on the upper side of the steam generator 200 to be spaced apart from the steam generator 200. That is, the water tank 120 may be disposed on the upper side of the steam generator 200 with the upper housing 112 interposed therebetween.

In a state in which the water tank 120 is mounted on the module housing 110, the water tank 120 may form the outer appearance of the wet duster module 100.

Substantially the entire upper wall of the water tank 120 may form the outer appearance of the upper surface of the wet duster module 100. Accordingly, a user can visually check whether the water tank 120 is mounted on the module housing 110.

The module housing 110 may further include a water tank separation button operated to separate the water tank 120 in a state in which the water tank 120 is mounted on the module housing 110. For example, the water tank separation button may be located at the center of the wet duster module 100. Accordingly, there is an advantage in that the user can easily recognize the water tank separation button and manipulate the water tank separation button.

In a state in which the water tank 120 is mounted on the module housing 110, water from the water tank 120 may be supplied to the duster 150. Specifically, the water stored in the water tank 120 may be supplied to the duster 150 through the moisture supply unit 130.

Specifically, a space for storing water is formed in the water tank 120. The water stored in the water tank 120 may be supplied to the steam generator 200 through at least one tube (hose). The water introduced into the steam generator 200 may be heated, and it is possible to change the phase of the water into steam (water vapor) according to a user's selection. The water or steam heated by the steam generator 200 may be supplied to the duster 150 through the diffuser 137.

The water tank 120 includes a water supply port. The water supply port is a hole through which water flows into the water tank 120. For example, the water supply port may be formed on the side of the water tank 120.

The water tank 120 includes a drain hole. The drain hole is a hole through which water stored in the water tank 120 is discharged. The water discharged from the drain may flow to the steam generator 200. The drain hole may be formed on the lower surface of the water tank 120.

The water tank 120 includes an air hole. The air hole is a hole through which air can be introduced into the water tank 120. When the water stored in the water tank 120 is discharged to the outside, the pressure inside the water tank 120 is lowered, and air can be introduced into the water tank 120 through the air hole to compensate for the lowered pressure. For example, the air hole may be formed at the upper end of the water tank 120.

The wet duster module 100 of the present invention may include the moisture supply unit 130 having a flow path for supplying water flowing in from the water tank 120 to the duster 150.

Specifically, the moisture supply unit 130 may include a water tank connection unit 131 for introducing water from the water tank 120 into the module housing 110, a water inlet pipe 132 for supplying the water introduced into the water tank connection part 131 to a water pump 133, a guide pipe 134 for supplying water from the water pump 133 to a T-shaped connector, and a water supply pipe 135 for supplying the water introduced through the connector to the steam generator 200.

The water tank connection unit 131 may operate a valve (not shown) in the water tank 120, and water may flow therethrough.

The water tank connection unit 131 may be coupled to the lower side of the upper housing 112, and a portion of the water tank connection unit may pass through the upper housing 112 and protrude upward.

When the water tank 120 is seated on the upper housing 112, the water tank connection unit 131 protruding upward may pass through the outlet of the water tank 120 and be drawn into the water tank 120.

A sealer for preventing the water discharged from the water tank 120 from leaking around the water tank connection unit 131 may be provided in the upper housing 112. The sealer may be formed of, for example, a rubber material, and may be coupled to the upper housing 112 at the upper side of the upper housing 112.

The water pump 133 for controlling the discharge of water from the water tank 120 may be installed in the upper housing 112.

The water pump 133 may provide a flow force of water. The water pump 133 may include a first connection port to which the water inlet pipe 132 is connected, and a second connection port to which the guide pipe 134 is connected. In this case, based on the water pump 133, the first connection port may be an inlet, and the second connection port may be an outlet.

The water pump 133 is a pump that expands or contracts by the operation of an internal valve body to communicate the first connection port and the second connection port, and may be implemented by a known structure, so detailed descriptions will be omitted.

The water supply pipe 135 may connect the connector and the water inlet 212 of the steam generator 200. For example, the water supply pipe 135 may be a pair of pipes branched from the connector.

Accordingly, after the water supplied to the water inlet pipe 132 flows into the water pump 133, it flows into the guide pipe 134. The water flowing to the guide pipe 134 flows to the water supply pipe 135 by the connector. Then, the water flowing through the water supply pipe 135 is supplied to the steam generator 200.

The steam generator 200 is a device for heating water. The steam generator 200 is disposed inside the module housing 110. Specifically, the steam generator 200 is installed on the upper surface of the lower housing 111.

Meanwhile, in the present invention, the steam generator 200 is disposed to be inclined. Specifically, based on the state in which the module housing 110 is placed on the floor, the bottom of the steam generator 200 may be disposed to form a predetermined angle $\alpha$ with the floor.

The specific structure and effect of the steam generator 200 of the present invention will be described later.

The diffuser 137 is configured to discharge the water from the water tank 120 to the duster 150.

Specifically, the diffuser 137 may include at least one or more nozzles, and may supply the moisture discharged from the steam generator 200 to the duster 150 through the nozzles.

The diffuser 137 may be accommodated in a space formed inside the module housing 110, and a portion of the diffuser 137 may pass through a nozzle hole (not shown) formed in the module housing 110 to be exposed to the outside of the module housing 110.

The diffuser 137 may be mounted in a pair on the module housing 110 and arranged in the left-right direction. In addition, the pair of diffusers 137 arranged in the left-right direction may be formed in a shape symmetrical to each other (mirror image).

The diffuser 137 may be connected to the steam generator 200 to supply moisture flowing through the steam generator 200 to the duster 150.

The diffuser 137 includes a diffuser body 137*a* and a connection pipe 137*b*.

The diffuser body 137*a* has a diffusion passage through which moisture can flow therein, and includes a nozzle through which the moisture flowing through the diffusion passage is discharged to the duster. For example, the diffuser body 137*a* may be formed in an arc shape, and a plurality of nozzles may be provided at predetermined intervals. With such a configuration, the diffuser body 137*a* can stably supply moisture to the disk-shaped duster 150.

Figure 10:
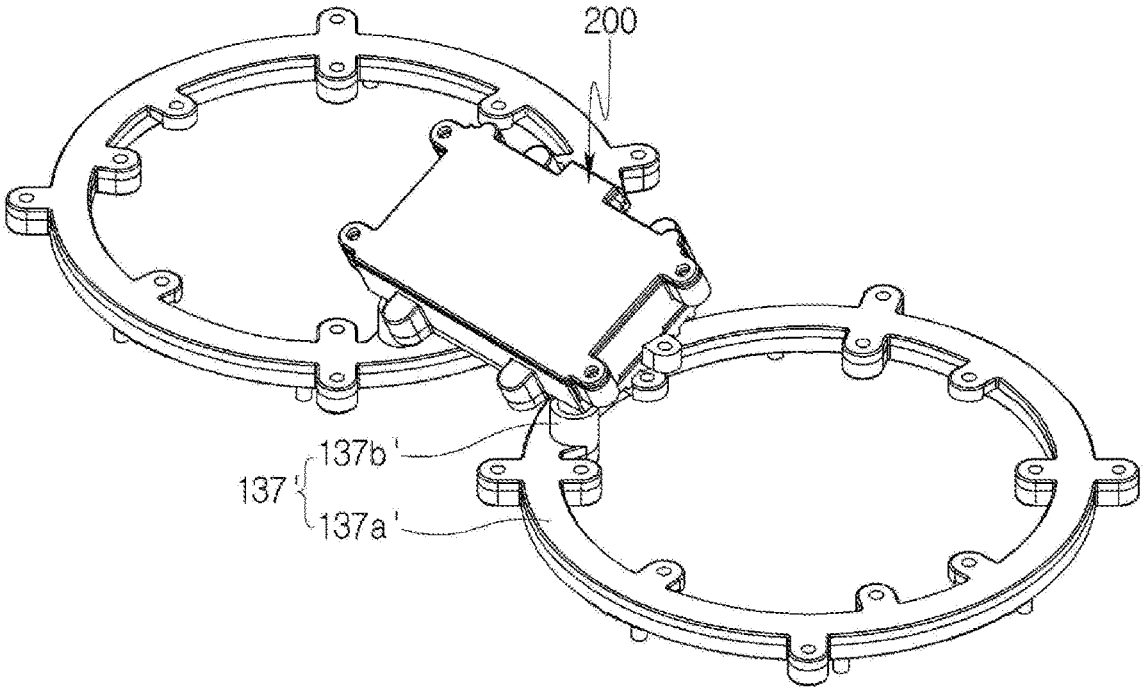
FIG. 10 is a perspective view for explaining a diffuser in a wet duster module according to another embodiment of the present invention.

As another example, the diffuser body may be formed in an annular shape, and a plurality of nozzles may be provided along the circumferential direction at predetermined intervals. With this configuration, the diffuser body 137*a* can quickly supply moisture to the entire disk-shaped duster 150 (see FIG. 10).

A connection pipe 137*b* is provided in the diffuser body 137*a* and may be coupled to the moisture outlet 213 of the steam generator 200. The flow path formed inside the connection pipe 137*b* may communicate with the diffusion flow path formed in the moisture outlet 213 and the diffuser body 137*a*. With this configuration, the moisture discharged from the steam generator 200 may be discharged to the duster 150 through the diffuser body 137*a* after passing through the connection pipe 137*b*.

Then, the moisture sprayed from the diffuser 137 is supplied to the duster 150 after passing through the water passage hole formed in the rotation cleaning unit 140. The duster 150 is rotated while absorbing the moisture supplied through the diffuser 137 to wipe the floor.

The rotation cleaning unit 140 may rotate by receiving power from the duster drive motor 170. For example, the rotation cleaning unit 140 may be a rotating plate. The rotation cleaning unit 140 may be formed in a disk shape, and the duster 150 may be attached to the lower surface of the rotation cleaning unit.

In this case, the rotation cleaning unit 140 in the form of a disk may be disposed in parallel with the floor in a state where the wet duster module 100 is placed on the floor. Alternatively, the rotation cleaning unit 140 in the form of a disk may be disposed in parallel with the bottom 111*a* of the lower housing 111.

The rotation cleaning unit 140 may be located, for example, at the lower side of the module housing 110 and at the rear of the suction port 113*a*.

Therefore, when cleaning while moving the wet duster module 100 forward, the floor can be wiped with the duster 150 after the foreign substances and air of the floor are sucked by the suction port 113*a*.

At least one rotation cleaning unit 140 may be provided on the lower side of the module housing 110. For example, the rotation cleaning unit 140 may include the first rotation cleaning unit 141 connected to a first duster drive motor 171 and to which a first duster 151 is attached, and the second rotation cleaning unit 142 connected to a second duster drive motor 172 and to which a second duster 152 is connected.

Specifically, the rotation cleaning unit 140 includes a circular ring-shaped outer body, an inner body positioned in the central region of the outer body and spaced apart from the inner circumferential surface of the outer body, and a plurality of connection ribs connecting the outer circumferential surface of the inner body and the inner circumferential surface of the outer body.

In addition, the rotation cleaning unit 140 may include a plurality of water passage holes formed along the circumferential direction in order to supply the water discharged through the diffuser 137 to the duster 150.

On the other hand, the rotation cleaning unit 140 may include an attachment means for attaching the duster 150. For example, the attachment means may be Velcro.

The rotation cleaning unit 140 may be disposed on the lower side of the lower housing 111. That is, the rotation cleaning unit 140 may be disposed outside the module housing 110.

In addition, the rotation cleaning unit 140 may be connected to the duster drive motor 170 to receive power. For example, the rotation cleaning unit 140 may be connected to the duster drive motor 170 through at least one or more gears, and may be rotated by the operation of the duster drive motor 170.

The rotation cleaning unit 140 may include the first rotation cleaning unit 141 and the second rotation cleaning unit 142. For example, based on the suction port 113*a* in a state in which the wet duster module 100 is placed on the floor, the first rotation cleaning unit 141 may refer to the rotation cleaning unit 140 disposed on the left side, and the second rotation cleaning unit 142 may refer to the rotation cleaning unit 140 disposed on the right side, but is not limited thereto, and the left and right sides may be switched.

In this embodiment, the rotation center of the first rotation cleaning unit 141 and the rotation center of the second rotation cleaning unit 142 are disposed to be spaced apart in the left-right direction.

The rotation center of the rotation cleaning unit 140 may be positioned farther from the front end of the module housing 110 than the central axis that bisects the front and rear lengths of the module housing 110. This is to prevent the rotation cleaning unit 140 from blocking the suction port 113*a*.

The distance between the rotation center of the first rotation cleaning unit 141 and the rotation center of the second rotation cleaning unit 142 may be greater than the diameter of the duster 150. This is to reduce the friction between the first duster 151 and the second duster 152 as they interfere with each other in the course of rotation, and to prevent the cleaning area from being reduced by the interfering portion.

The duster 150 may wipe the floor by rotational motion.

The duster 150 may be coupled to the lower side of the rotation cleaning unit 140 to face the floor.

The duster 150 is made so that the bottom facing the floor has a predetermined area, and the duster 150 is made in a flat shape. The duster 150 is formed in a form in which a width (or diameter) in the horizontal direction is sufficiently larger than a height in the vertical direction. When the duster 150 is coupled to the lower housing 111, the bottom of the duster 150 may be parallel to the floor.

The bottom of the duster 150 may form a substantially circular shape, and the duster 150 may be formed in a rotationally symmetrical form as a whole. In addition, the duster 150 may be detachably attached to the bottom of the rotation cleaning unit 140, be coupled to the rotation cleaning unit 140 and rotate together with the rotation cleaning unit 140.

In a state in which the rotation cleaning unit 140 and the duster 150 are coupled to the lower side of the module housing 110, a portion of the duster 150 protrudes to the outside of the wet duster module 100. Therefore, it is possible to clean not only the floor positioned below the wet duster module 100 but also the floor positioned on the outside of the wet duster module 100.

For example, the duster 150 may protrude not only to both sides of the wet duster module 100 but also to the rear of the module.

The duster 150 may include the first duster 151 coupled with the first rotation cleaning unit 141 and the second duster 152 coupled with the second rotation cleaning unit 142. Therefore, when the first rotation cleaning unit 141 is rotated by receiving the power of the first duster drive motor 171, the first duster 151 is also rotated, and when the second rotation cleaning unit 142 is rotated by receiving the power of the second duster drive motor 172, the second duster 152 may also be rotated.

Meanwhile, in this embodiment, the wet duster module 100 may further include the light emitting module 160.

The light emitting module 160 may irradiate light to the front of the wet duster module 100 to confirm foreign substances or microorganisms present in front of the wet duster module 100.

The light emitting module 160 may be disposed in the front of the module housing 110. For example, the light emitting module 160 may be disposed on the front of the lower housing 111, and a plurality of light emitting modules 160 may be disposed along the left-right direction. In this case, the light emitting module 160 may be disposed on the rear of the cooling air inlet 117. Through this arrangement, the light emitting module 160 may be cooled by the air introduced from the cooling air inlet 117.

Meanwhile, the light emitting module 160 may include a light emitting member and a diffusion plate.

The light emitting member may irradiate light forward or downward. For example, the light emitting member may be composed of a plurality of LEDs. In this case, the light irradiated by the light emitting member may be visible light, and may be infrared (IR) or ultraviolet (UV), depending on the embodiment. With such a configuration, when the light emitting member is operated, it is possible not only to check the presence of foreign substances or microorganisms in front of the wet duster module 100, but also to sterilize the foreign substances or microorganisms present in front of the wet duster module 100 to improve hygiene.

In addition, the diffusion plate may be disposed in the front of the light emitting member to diffuse the light irradiated from the light emitting member.

On the other hand, the wet duster module 100 may further include the duster drive motor 170 that provides power to rotate the duster 150 and the rotation cleaning unit 140.

Specifically, the duster drive motor 170 may include the first duster drive motor 171 for rotating the first rotation cleaning unit 141 and the second duster drive motor 172 for rotating the second rotation cleaning unit 142.

As such, since the first duster drive motor 171 and the second duster drive motor 172 operate individually, even if any one of the first duster drive motor 171 and the second duster drive motor 172 fails, there is an advantage that the rotation of the rotation cleaning unit 140 is possible by the other one.

On the other hand, the first duster drive motor 171 and the second duster drive motor 172 may be arranged spaced apart in the left-right direction in the module housing 110. In addition, the first duster drive motor 171 and the second duster drive motor 172 may be positioned at the rear of the suction port 113*a*.

The duster drive motor 170 may be disposed in the module housing 110. For example, the duster drive motor 170 may be seated on the upper side of the lower housing 111 and covered by the upper housing 112. That is, the duster drive motor 170 may be positioned between the lower housing 111 and the upper housing 112.

Meanwhile, the wet duster module 100 includes the connection pipe 180 coupled to the cleaner body 400 or the extension pipe 300.

The connection pipe 180 includes a first connection pipe 181 connected to an end of the flow path forming unit 113, a second connection pipe 182 rotatably connected to the first connection pipe 181, and a guide pipe for communicating the insides of the first connection pipe 181 and the second connection pipe 182.

The first connection pipe 181 may be formed in a tube shape, so that one end of the axial direction is connected to the end of the flow path forming unit 113, and the other end of the first connection pipe in the axial direction may be rotatably coupled to the second connection pipe 182. In this case, the first connection pipe 181 may be formed in a form in which a portion of the outer peripheral surface is cut, and the cut portion may be disposed to face the second connection pipe 182 and the upper side. With this configuration, in a state where the wet duster module 100 is placed on the ground, the angle between the second connection pipe 182 and the ground may be changed according to the movement of the user's arm. That is, the first connection pipe 181 and the second connection pipe 182 may serve as a kind of joint capable of adjusting the angle between the wet duster module 100 and the cleaner body 400.

The second connection pipe 182 is formed in the form of a tube so that one end in the axial direction is rotatably coupled to the first connection pipe 181, and the other end in the axial direction is detachably coupled by being inserted in the cleaner body 400 or the extension pipe 300.

On the other hand, in the present embodiment, an auxiliary battery housing in which an auxiliary battery (not shown) is accommodated may be coupled to the second connection pipe 182.

Meanwhile, electric wires may be embedded in the first connection pipe 181 and the second connection pipe 182, and the electric wires embedded in the first connection pipe 181 and the second connection pipe 182 may be electrically connected to each other.

Meanwhile, the guide pipe may connect the inner space of the first connection pipe 181 and the inner space of the second connection pipe 182. The guide pipe may have a flow path formed therein so that the air sucked from the wet duster module 100 flows to the extension pipe 300 and/or the cleaner body 400. In this case, the guide pipe may be deformed together according to the rotation of the first connection pipe 181 and the second connection pipe 182. As an example, the guide pipe may be formed in the form of a corrugated tube (jabara).

On the other hand, the wet duster module 100 may include the printed circuit board 190 on which a wet duster module controller 700 for controlling the wet duster module 100 is disposed. A current may be applied to the printed circuit board 190 and a communication line may be disposed thereon. In this case, the printed circuit board 190 may be cooled by air introduced into the cooling air inlet 117 and discharged through the cooling air outlet 118.

Meanwhile, the module housing 110 may further include the first manipulator 191 for controlling the amount of water discharged from the water tank 120. For example, the first manipulator 191 may be located at the rear side of the module housing 110.

The first manipulator 191 may be operated by a user, and water may or may not be discharged from the water tank 120 by the manipulation of the first manipulator 191.

Alternatively, the amount of water discharged from the water tank 120 may be adjusted by the first manipulator 191. For example, as the user operates the first manipulator 191, water may be discharged from the water tank 120 by a first amount per unit time, or water may be discharged by a second amount greater than the first amount per unit time.

The first manipulator 191 may be provided to pivot in the left-right direction on the module housing 110 or may be provided to pivot in the up-down direction according to an embodiment.

For example, when the first manipulator 191 is positioned in a neutral position, the water discharge is zero (0), and when the left side of the first manipulator 191 is pushed so that the first manipulator 191 is pivoted to the left, the first amount of water may be discharged from the water tank 120 per unit time. In addition, when the right side of the first manipulator 191 is pushed so that the first manipulator 191 is pivoted to the right, the second amount of water may be discharged from the water tank 120 per unit time.

Meanwhile, the module housing 110 may further include the second manipulator 192 for controlling the phase of moisture discharged from the steam generator 200. For example, the second manipulator 192 may be positioned at the rear side of the module housing 110.

The second manipulator 192 can be manipulated by the user, and by the manipulation of the second manipulator 192, water or steam (water vapor) can be discharged from the steam generator 200 to the duster 150.

The second manipulator 192 may be provided to rotate on the module housing 110. For example, the second manipulator 192 may be a rotary knob (dial).

For example, in a state in which the second manipulator 192 is rotated and positioned at the first position, the water at room temperature may be discharged to the duster 150 without heating the water in the steam generator 200. In addition, in a state in which the second manipulator 192 is rotated to be positioned at a second position different from the first position, the steam generator 200 may heat water to discharge the water to the duster 150. In addition, in a state in which the second manipulator 192 is rotated to be positioned in a third position different from the first position and the second position, the water is heated in the steam generator 200 to change the phase of the water into steam (water vapor), and then discharge it to the duster 150.

Figure 9:
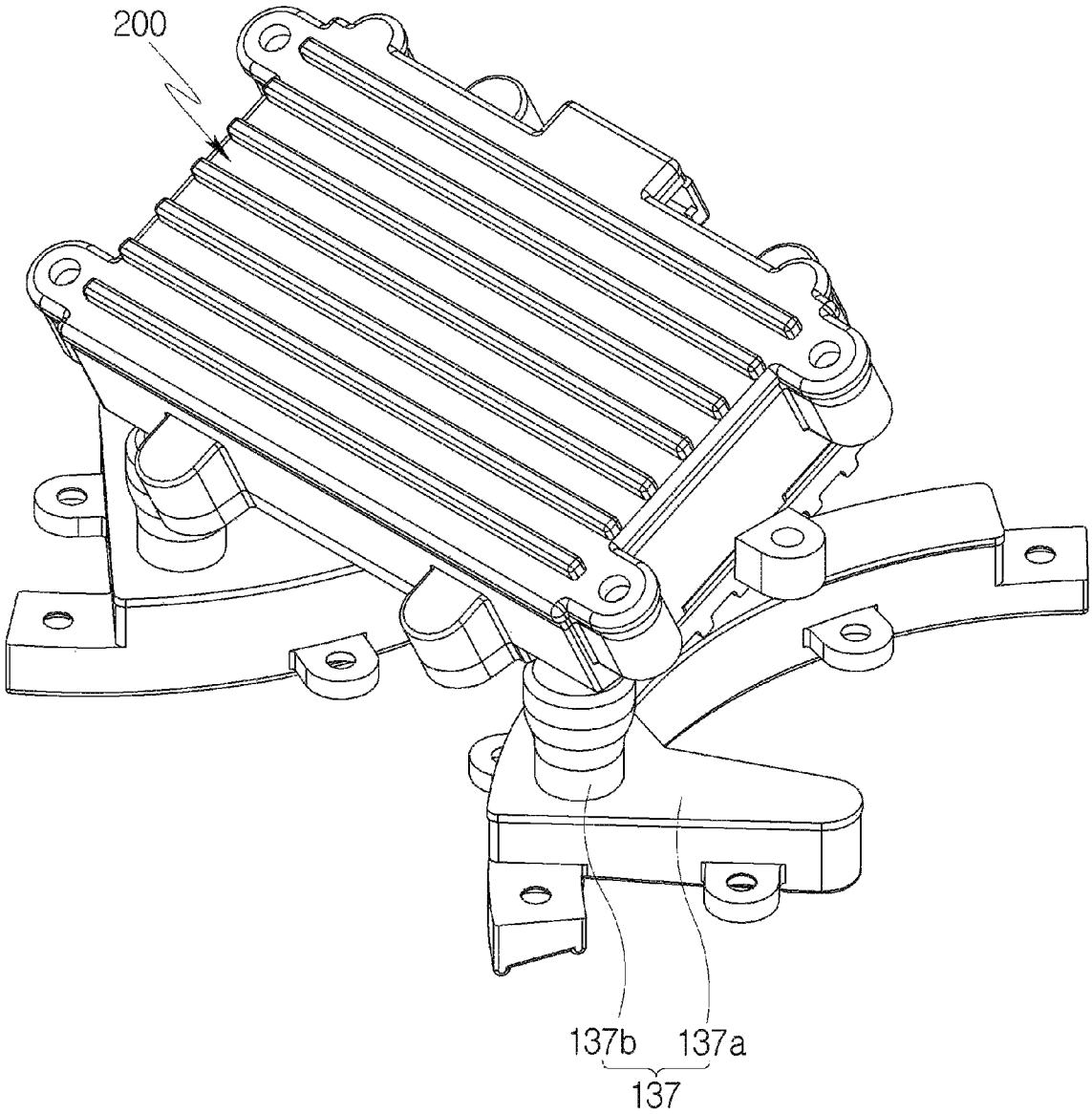
FIG. 9 is a perspective view for explaining a steam generator in a wet duster module according to an embodiment of the present invention.
Figure 11:
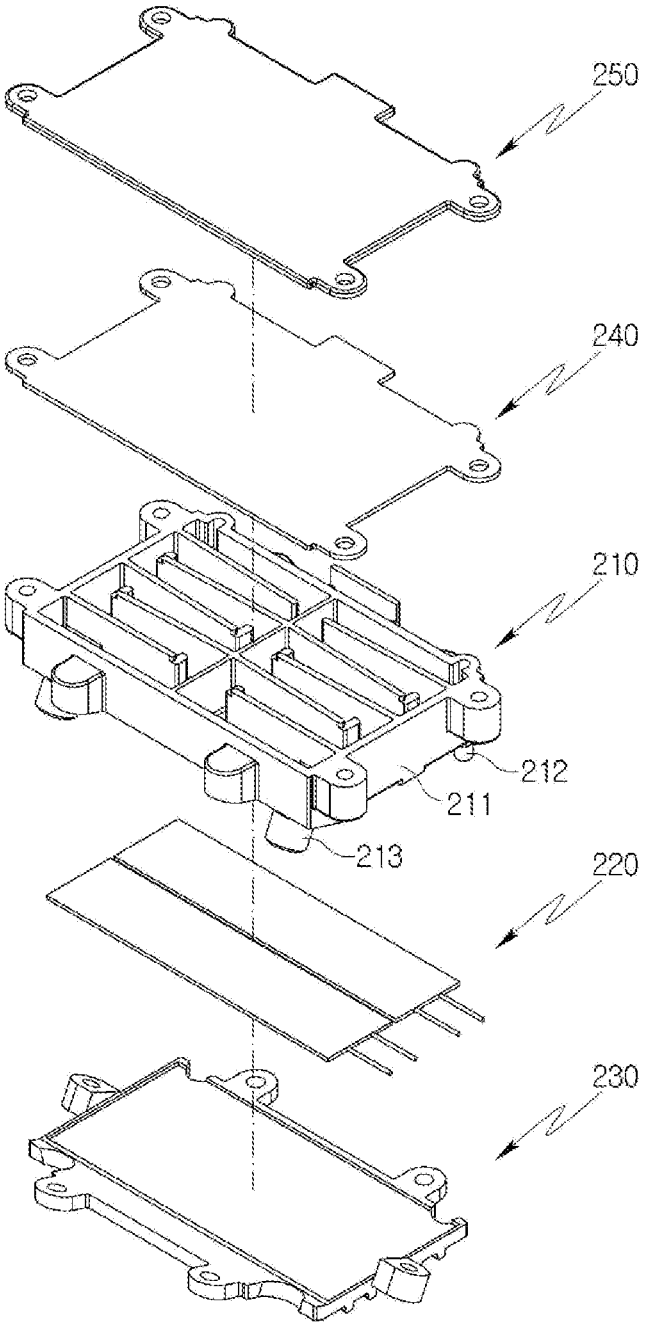
FIG. 11 is an exploded perspective view for explaining a steam generator in a wet duster module according to an embodiment of the present invention.
Figure 12:
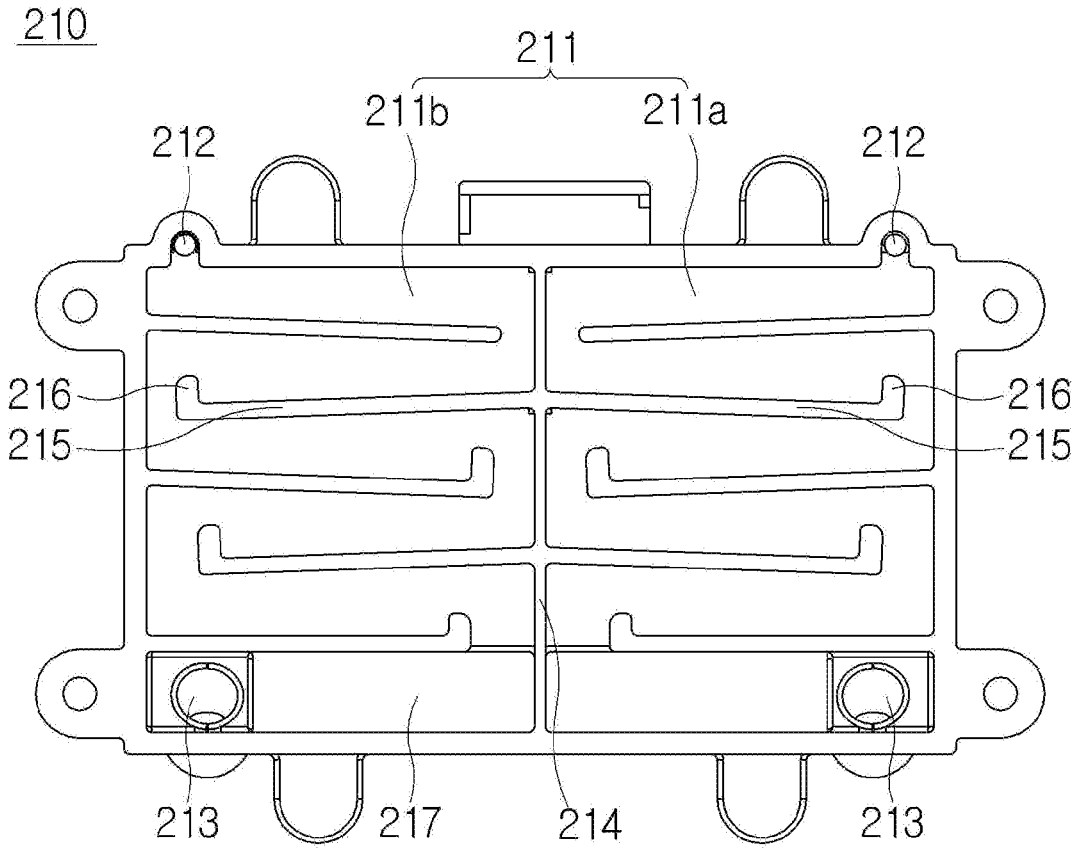
FIG. 12 is a plan view for explaining a heating chamber of a steam generator in a wet duster module according to an embodiment of the present invention.

FIG. 9 is a perspective view for explaining the steam generator in the wet duster module according to an embodiment of the present invention, FIG. 11 is an exploded perspective view for explaining the steam generator in the wet duster module according to an embodiment of the present invention, and FIG. 12 is a plan view for explaining the heating chamber of the steam generator in the wet duster module according to an embodiment of the present invention.

The steam generator 200 according to an embodiment of the present invention will be described with reference to FIGS. 9 to 12.

The steam generator 200 may generate high-temperature water or steam (water vapor) by heating water. The steam generator 200 may heat the water supplied from the water tank 120 and supply it to the duster 150.

The steam generator 200 is provided in the wet duster module 100 rather than the cleaner body 400. This is to prevent inconvenient cleaning due to the weight and volume of the steam generator during dry cleaning when the steam generator is disposed on the cleaner body.

The steam generator 200 may be coupled to the upper part (the upper surface of the bottom 111*a*) of the lower housing 111. For example, the steam generator 200 may be coupled to the upper surface of the flow path forming unit 113. In this case, since the flow path forming unit 113 is coupled to the upper central part of the lower housing 111, the steam generator 200 may also be disposed in the central part of the lower housing 111. With this configuration, when the steam generator 200 is operated, a specific location may not be overheated by the heat supplied from the steam generator 200, thereby preventing damage to the wet duster module 100. In addition, the overall volume of the wet duster module 100 can be minimized.

The steam generator 200 may include a heating chamber 210, a heater 220, a lower cover 230, a sealer 240, an upper cover 250, and a temperature detector 260. In this case, the heater 220 may be disposed on the lower side of the heating chamber 210, and the lower cover 230 may be disposed on the lower side of the heater 220 to cover the lower side of the steam generator 200. In addition, the sealer 240 may be disposed on the upper side of the heating chamber 210, and the upper cover 250 may be disposed on the upper side of the sealer 240 to cover the upper side of the steam generator 200. Meanwhile, the temperature detector 260 is preferably provided inside the heating chamber 210, but is not limited thereto, and may be provided outside the heating chamber 210.

The heating chamber 210 may provide a space in which a flow path through which moisture flows is formed, and the heat generated from the heater 220 is received to heat the moisture flowing through the flow path.

Specifically, the heating chamber 210 includes a chamber body 211, the water inlet 212, the moisture outlet 213, a partition wall 214, a flow guide wall 215, a flow delay protrusion 216, and a water storage groove 217.

The chamber body 211 may form an outer appearance of the heating chamber 210 and provide a space in which moisture may flow. For example, the chamber body 211 may be formed in a shape similar to a rectangular box. For example, the chamber body 211 may have a bottom of a square plate shape formed at the lowermost side and four side walls perpendicular to the bottom and connected to the bottom. In addition, the upper part of the chamber body 211 may be in an open shape. Accordingly, the interior of the chamber body 211 may be referred to as a space surrounded by the bottom and the four side walls. In this case, the four side walls may be referred to as a front side wall, a rear side wall, a left side wall, and a right side wall, respectively, according to their arranged positions.

On the other hand, the chamber body 211 may be separated from the inner space by the partition wall 214 to be described later. For example, a space disposed on the left side with respect to the partition wall 214 may be called a first chamber 211*a*, and a space disposed on the right side with respect to the partition wall 214 may be called a second chamber 211*b*. It is also possible that the left and right sides of the first chamber 211*a* and the second chamber 211*b* are switched.

Meanwhile, the water inlet 212 and the moisture outlet 213 may be formed in the chamber body 211. Specifically, the water inlet 212 and the moisture outlet 213 may be formed on the bottom of the chamber body 211. In this case, it is preferable that the water inlet 212 and the moisture outlet 213 are disposed farthest along the front-rear direction of the wet duster module 100. This is to secure sufficient heating time by maximizing the distance through which the water flowing into the water inlet 212 flows until it is discharged through the moisture outlet 213.

For example, the rear end of the chamber body 211 is disposed on the upper side than the front end of the chamber body 211. That is, the steam generator 200 has a backward-upward slope. Accordingly, water may be heated while flowing from the upper rear to the lower front of the steam generator 200.

The water inlet 212 is formed in the chamber body 211, and water may be introduced from the water tank 120 to the water inlet. The water inlet 212 may be a hole formed at the inlet end of the chamber body 211.

Specifically, the water supply pipe 135 of the water supply unit 130 may be connected to the water inlet 212. For example, the water supply pipe 135 may be coupled to the lower side of the chamber body 211, and the flow path inside the water supply pipe 135 and the water inlet 212 may communicate with each other. Accordingly, when the water pump 133 is operated, the water stored in the water tank 120 by the flow force generated by the water pump 133 may flow through the water supply pipe 135 and then flow into the chamber body 211.

The moisture outlet 213 may discharge the moisture heated inside the chamber body 211. The moisture outlet 213 may be a hole formed at the outlet end of the chamber body 211.

Specifically, the diffuser 137 may be connected to the moisture outlet 213. For example, the diffuser 137 may be coupled to the lower side of the chamber body 211, and the flow path inside the diffuser 137 and the moisture outlet 213 may communicate with each other. Accordingly, the moisture (water or steam) heated inside the chamber body 211 may pass through the moisture outlet 213 and flow into the diffuser 137, and then may be supplied to the duster 150.

On the other hand, in general, the bottom of the steam generator is arranged parallel to the floor of the place where the generator is installed. In addition, a pipe through which steam is discharged is provided at the upper part of the steam generator. Accordingly, when the steam generator is operated and steam (water vapor) is generated, the heated steam rises and is discharged along the pipe to the outside.

However, in the case of the steam generator having such a structure, there is a high possibility that the steam may come into contact with the inner wall or pipe of the steam generator while the steam rises, and thus the drain may be generated. Therefore, it is necessary to reduce the amount of heat loss that may occur during the flow of steam, and to reheat and supply it to the duster even if drain is generated.

In order to solve this problem, the steam generator 200 according to the embodiment of the present invention is disposed to be inclined at a predetermined angle with respect to the floor.

Specifically, in the state in which the wet duster module 100 is placed on the floor (the state in which the duster 150 is placed on the floor and can wipe the floor), the bottom of the chamber body 211 may be inclined at a predetermined angle $\alpha$ with the floor.

The bottom 111*a* of the lower housing 111 to which the rotation cleaning unit 140 and the duster 150 are coupled at the lower side thereof and the bottom of the chamber body 211 may be inclined at a predetermined angle $\alpha$. That is, the virtual extension surface of the bottom the chamber body 211 may intersect with the virtual extension surface of the bottom 111*a* of the lower housing 111.

In addition, the height from the floor to the water inlet 212 may be higher than the height from the floor to the moisture outlet 213. In addition, the distance from the bottom 111*a* of the lower housing 111 to the water inlet 212 may be greater than the distance from the bottom 111*a* to the moisture outlet 213.

In addition, the shortest distance from the rotation cleaning unit 140 in the disk shape to the water inlet 212 may be greater than the shortest distance from the rotation cleaning unit 140 to the moisture outlet 213. In addition, the bottom of the chamber body 211 may be inclined at a predetermined angle α with the virtual extension surface of the rotation cleaning unit 140 in the form of a disk. That is, the virtual extension line of the bottom of the chamber body 211 may intersect with the virtual extension surface of the rotation cleaning unit 140.

With this configuration, the water introduced into the water inlet 212 may be heated while flowing from the upper part to the lower part in the chamber body 211 by gravity, even if it is heated and has upward conviction motion.

Moreover, even if the water heated inside the chamber body 211 rises through a phase change into water vapor, it is not discharged to the upper part of the chamber body 211 and remains inside the chamber body 211 and may be additionally heated.

In addition, the drain generated inside the steam generator 200 may be continuously heated without being discharged to the outside.

The partition wall 214 may be formed to protrude upward from the bottom of the chamber body 211 along the front-rear direction of the wet duster module 100. For example, the partition wall 214 may be a wall connecting the side walls (the front side wall and the rear side wall) disposed in the front and rear of the chamber body 211.

With such a configuration, the partition wall 214 may separate the inner space of the chamber body 211 to the left and right. That is, the inner space of the chamber body 211 may be divided into a first chamber 211*a* and a second chamber 211*b* with the partition wall 214 as a boundary.

Accordingly, the moisture flowing through the inside of the first chamber 211*a* and the moisture flowing through the inside of the second chamber 211*b* do not mix with each other and may be independently heated. As a result, the temperature inside the first chamber 211*a* and the temperature inside the second chamber 211*b* may be different from each other, and the moisture discharged from the first chamber 211*a* and the moisture discharged from the second chamber 211*b* may have different phases from each other. For example, steam may be discharged from the first chamber 211*a* and water may be discharged from the second chamber 211*b*.

The flow guide wall 215 is formed to protrude inside the chamber body 211, and at least one may be formed along the left-right direction.

Specifically, the flow guide wall 215 is formed to protrude vertically from the bottom of the chamber body 211. In this case, based on the bottom of the chamber body 211, the flow guide wall 215 is formed to protrude along the left-right direction of the wet duster module 100, it may be formed to be inclined toward the front at a predetermined angle. Alternatively, based on the direction of gravity, the flow guide wall 215 may be formed to protrude along the left-right direction of the wet duster module 100, and be inclined downward at a predetermined angle. In addition, based on the direction in which the water in the heating chamber 210 flows, the space between the plurality of flow guide walls 215 may be formed to gradually widen from the inlet side toward the outlet side.

In addition, the flow guide wall 215 may be connected to the side walls in the left-right direction (left and right side walls) or partition wall 214 of the chamber body 211.

That is, one end of the flow guide wall 215 may be connected to the flow delay protrusion 216, and the other end of the flow guide wall 215 may be connected to the sidewall or partition wall 214 of the chamber body 211. In this case, one end of the flow guide wall 215 may be disposed closer to the floor (downward in the direction of gravity) than the other end.

With this configuration, a flow path through which water may flow may be formed between the partition wall 214 and the flow guide wall 215 or between the sidewall of the chamber body 211 and the flow guide wall 215.

Meanwhile, in the present embodiment, a plurality of flow guide walls 215 may be formed. In this case, the plurality of flow guide walls 215 may be alternately connected to the sidewall and partition wall 214 of the chamber body 211.

With this configuration, the flow path inside the chamber body 211 may be formed in a zigzag shape. As a result, it is possible to increase the flow path of the water flowing inside the chamber body 211 and secure sufficient time for heating the water inside the chamber body 211. In addition, there is an effect of increasing an area capable of transferring heat to the water flowing inside the chamber body 211. In addition, even if the steam generator 200 is shaken, there is an effect of maintaining the flow direction of moisture to maintain the supply amount of water or steam.

The flow delay protrusion 216 may protrude from one end of the flow guide wall 215. Specifically, it may be formed to protrude backward from one end of the flow guide wall 215.

Meanwhile, in the present embodiment, the rear (or upper side) end of the flow delay protrusion 216 may be disposed farther from the floor (upward in the direction of gravity) than the other end of the flow guide wall 215.

With this configuration, the water flowing along the flow guide wall 215 may come into contact with the flow delay protrusion 216, and the flow rate of water may be reduced. Accordingly, sufficient time can be secured so that the water flowing into the steam generator 200 is heated to a target temperature.

The water storage groove 217 is concavely formed in the bottom of the chamber body 211. The water storage groove 217 may be disposed in the front of the bottom of the chamber body 211. In addition, the water storage groove 217 may receive water that flows along the flow guide wall 215 in the bottom of the chamber body 211 close to the floor (downward in the direction of gravity). In addition, the lowermost portion of the water storage groove 217 may be disposed closer to the floor (downward in the direction of gravity) than the moisture outlet 213.

With such a configuration, water that is not phase-changed into steam while flowing inside the chamber body 211 may be collected in the water storage groove 217 and continuously heated. Accordingly, even if the steam generator 200 is shaken, it is possible to prevent water that is not sufficiently heated from being suddenly discharged to the moisture outlet 213.

The heater 220 may generate heat. The heater 220 is a device capable of converting electrical energy into thermal energy, and may be implemented with a known structure, and thus a detailed description thereof will be omitted.

The heater 220 may be disposed on the lower side of the heating chamber 210 and supply heat to the heating chamber 210. Specifically, the heater 220 may be in contact with the bottom of the heating chamber 210. Accordingly, when heat is generated by the heater 220, the heating chamber 210 in contact with the heater 220 may be heated by conduction. Accordingly, the heater 220 may receive power from a battery (not shown) and/or an auxiliary battery 600 provided in the cleaner body 400 to heat water flowing in the heating chamber 210.

Meanwhile, the heater 220 may adjust the temperature of water according to a user's input. In addition, the heater 220 may change the phase of water into steam (water vapor) according to a user's input.

Meanwhile, in the present embodiment, a plurality of heaters 220 may be provided, and each heater 220 may independently generate heat. For example, two heaters 220 may be provided, one of which may be disposed on the lower side of the first chamber 211*a*, and the other may be disposed on the lower side of the second chamber 211*b*. With such a configuration, the temperature inside the first chamber 211*a* and the temperature inside the second chamber 211*b* may be different from each other, and the phase of the moisture discharged from the first chamber 211*a* and the phase of the moisture discharged from the second chamber 211*b* may be different from each other.

The lower cover 230 may be disposed on the lower side of the heater 220 and cover the heater 220. For example, the lower cover 230 may be formed in a flat plate shape, and may be formed in a shape that can surround the heater 220. The lower cover 230 may be formed of a material capable of blocking heat generated from the heater 220. With such a configuration, energy efficiency can be improved by preventing heat generated from the heater 220 from escaping to the outside of the steam generator 200. In addition, it is possible to prevent the components accommodated in the module housing 110 from being damaged by the heat generated by the heater 220.

The sealer 240 may be disposed on the upper side of the heating chamber 210 and may seal the upper side of the heating chamber 210. Specifically, the sealer 240 may seal the open upper part of the chamber body 211. The sealer 240 may be formed of a material capable of blocking the passage of moisture. With this configuration, even if the water vapor generated inside the heating chamber 210 rises, it is blocked by the sealer 240 to prevent leakage of the water vapor to the outside.

The upper cover 250 may be disposed on the upper side of the sealer 240 and cover the sealer 240. For example, the upper cover 250 may be formed in a flat plate shape, and may be formed in a shape that can surround the sealer 240. The upper cover 250 may be formed of a material capable of blocking the heat transferred through the sealer 240. With such a configuration, energy efficiency can be improved by preventing the heat generated from the heater 220 from escaping to the outside of the steam generator 200. In addition, it is possible to prevent the components accommodated in the module housing 110 from being damaged by the heat generated by the heater 220.

The temperature detector 260 may measure the temperature of the steam generator 200. For example, the temperature detector 260 may be a thermistor. In this case, the temperature detector 260 may transmit information on the measured temperature of the steam generator 200 to the wet duster module controller 700. As another example, the temperature detector 260 may be a thermostat. In this case, when the temperature of the steam generator 200 exceeds a preset target temperature, the temperature detector 260 may cut off the supply of power to maintain the temperature of the steam generator 200 constant.

Meanwhile, the cleaner 1 of the present invention may include the extension pipe 300.

The extension pipe 300 may be coupled to the cleaner body 400 and the wet duster module 100.

For example, the extension pipe 300 may be formed in a long cylindrical shape. Accordingly, the inner space of the extension pipe 300 may communicate with the inner space of the wet duster module 100. In addition, the extension pipe 300 may communicate with a suction passage formed in the cleaner body 400.

When the suction power is generated through a suction motor (not shown), the suction power may be provided to the wet duster module 100 through the suction unit and extension pipe 300 of the cleaner body 400. Accordingly, external dust and air may be introduced into the cleaner body 400 through the wet duster module 100 and the extension pipe 300. In addition, dust and air introduced through the wet duster module 100 may be introduced into the cleaner body 400 after passing through the extension pipe 300.

On the other hand, the extension pipe 300 may have a built-in electric wire. Accordingly, the cleaner body 400 and the wet duster module 100 may be electrically connected through the extension pipe 300.

Meanwhile, the cleaner 1 of the present invention may include the cleaner body 400.

The cleaner body 400 may be configured to include a suction motor, a dust container, and a battery. The cleaner body 400 may receive power from the battery to operate the suction motor, and may generate suction force by the operation of the suction motor.

A suction flow path is formed in the cleaner body 400 so that the air and dust introduced from the wet duster module 100 may flow.

In addition, the cleaner body 400 may include at least one cyclone unit for separating dust sucked into the dust collector by applying the principle of a dust collector using centrifugal force. Accordingly, dust may be separated while the air introduced through the suction passage flows spirally.

In addition, the cleaner body 400 may include the dust container to store dust separated from the air sucked through the cyclone flow.

In addition, the cleaner body 400 is provided with an input unit so that the user can set whether or not to supply power and the intensity of air suction, as well as the rotation intensity of the duster, the amount of water supplied, whether or not to heat water, and whether or not to supply steam.

Meanwhile, the cleaner 1 of the present invention may include the auxiliary battery housing 500.

The auxiliary battery housing 500 is coupled to the wet duster module 100 or the extension pipe 300, and the auxiliary battery 600 may be detachably coupled thereto. For example, the auxiliary battery housing 500 may be coupled to the connection pipe 180 of the wet duster module 100, and may removably accommodate the auxiliary battery 600 therein.

For example, the auxiliary battery housing 500 may connect a battery (not shown) provided in the cleaner body 400 and the auxiliary battery 600 in series. With such a configuration, when a high power supply is required, such as when the steam generator 200 is operated, power can be stably supplied.

As another example, the auxiliary battery housing 500 may connect the battery (not shown) provided in the cleaner body 400 and the auxiliary battery 600 in parallel. With such a configuration, the operation time of the cleaner 1 can be extended.

As another example, the auxiliary battery housing 500 may electrically connect the auxiliary battery 600 to the steam generator 200. With such a configuration, the electric energy of the auxiliary battery 600 can be supplied to the steam generator 200 requiring high power supply.

Meanwhile, the cleaner 1 of the present invention may include the auxiliary battery 600.

The auxiliary battery 600 may supply power to the wet duster module 100 or the cleaner body 400. The auxiliary battery 600 may store electrical energy therein. For example, the auxiliary battery 600 may be a secondary battery.

Figure 13:
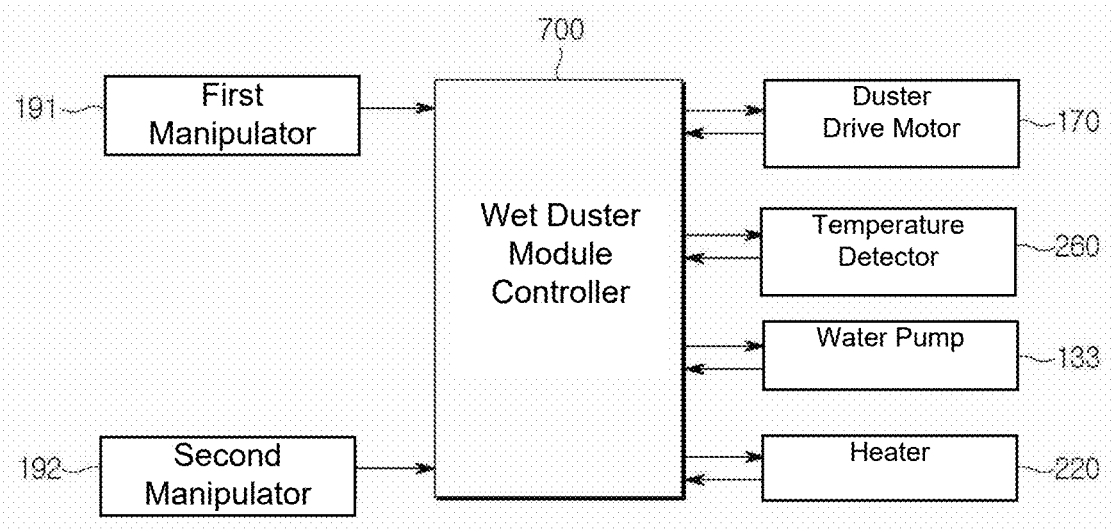
FIG. 13 is a block diagram for explaining the control configuration of a wet duster module according to an embodiment of the present invention.

FIG. 13 illustrates a view for explaining the control configuration of the wet duster module according to an embodiment of the present invention.

Referring to FIG. 13, the control configuration of the wet duster module 100 according to an embodiment of the present invention will be described as follows.

The wet duster module 100 according to an embodiment of the present invention includes the wet duster module controller 700.

The wet duster module controller 700 may include a memory (not shown) and a timer (not shown). Preset information may be stored in a memory (not shown). The timer (not shown) may measure time.

Although not illustrated, the wet duster module controller 700 may receive a control signal input through the cleaner body 400 or the wet duster module 100 or an external terminal (not shown). For example, the wet duster module controller 700 may be connected to the cleaner body 400 or the wet duster module 100 or an external terminal (not shown) through wired communication or wireless communication.

The wet duster module controller 700 may control the components included in the wet duster module 100.

The wet duster module controller 700 may be signally connected to the first manipulator 191 and the second manipulator 192. For example, the wet duster module controller 700 may be electrically connected to the first manipulator 191 and the second manipulator 192, and may transmit and receive electrical signals. With this configuration, the wet duster module 100 may receive a control signal based on a user input from the first operation unit 191 and/or the second operation unit 192 and operate according to the received control signal.

The wet duster module controller 700 may be signally connected to the temperature detector 260. The temperature detector 260 may measure the temperature of the steam generator 200 and transmit information on the temperature of the steam generator 200 to the wet duster module controller 700.

The wet duster module controller 700 may control the water pump 133. The wet duster module controller 700 may control the amount of moisture supplied from the water tank 120 to the duster 150 according to the control signal input from the first manipulator 191. For example, the wet duster module controller 700 may control the operation time of the water pump 133 according to the control signal input from the first manipulator 191.

The wet duster module controller 700 may control the heater 220. The wet duster module controller 700 may control the temperature and phase of the moisture supplied to the duster 150 according to the control signal input from the second manipulator 192. For example, the wet duster module controller 700 may control the operation time of the heater 220 and the amount of power applied to the heater 220 according to the control signal input from the second manipulator 192. In addition, when the temperature of the steam generator 200 measured by the temperature detector 260 is different from the preset target temperature, the wet duster module controller 700 may change the operating time of the heater 220 and the amount of power applied to the heater 220.

With such a configuration, according to the present invention, it is possible to maintain the temperature or phase of the water introduced into the steam generator 200, and it is possible to increase the energy efficiency.

In addition, according to an embodiment, the wet duster module controller 700 may control the light emitting module 160. The wet duster module controller 700 may control on/off the light emitting module 160 according to the user's control input. In addition, the wet duster module controller 700 is also possible to control the amount of light of the light emitting module 160 according to the user's control input.

In addition, according to an embodiment, the wet duster module controller 700 may control the duster drive motor 170. The wet duster module controller 700 may control the rotation speed (rpm) of the duster drive motor 170 according to the user's control input.

Although the present invention has been described in detail through specific examples, it is intended to describe the present invention in detail, and the present invention is not limited thereto. It is apparent that the present invention can be modified or improved by those skilled in the art within the technical spirit of the present invention.

All simple modifications or changes of the present invention fall within the scope of the present invention, and the specific protection scope of the present invention will become apparent from the appended claims.

What is claimed is:

1. A wet duster for a cleaner, comprising:

a housing;

a water tank coupled to the housing and configured to store water;

at least one rotation cleaning unit disposed at a lower side of the housing and configured to couple to a duster; and a steam generator configured to heat water supplied from the water tank, wherein the steam generator comprises:

a heating chamber that defines a flow path configured to carry moisture therein, the heating chamber comprising (i) a chamber body and (ii) at least one flow guide wall protruding from an inside of the chamber body, a water inlet defined at the chamber body and configured to receive water from the water tank, and a moisture outlet defined at the chamber body and configured to discharge steam, and wherein, in a state in which the duster is placed on a floor, the moisture outlet is disposed closer to the floor than the water inlet and the at least one flow guide wall.

2. The wet duster according to claim 1, wherein the heating chamber has a bottom surface configured to contact water, and wherein, in the state in which the duster is placed on the floor, the bottom surface of the heating chamber is inclined with respect to the floor by a predetermined angle.

3. The wet duster according to claim 1, wherein the heating chamber further comprises a flow delay protrusion that protrudes from an end of the at least one flow guide wall.

4. The wet duster according to claim 1, wherein the at least one flow guide wall is inclined with respect to a side wall of the chamber body.

5. The wet duster according to claim 1, wherein the heating chamber further comprises a partition wall that protrudes from a bottom surface of the chamber body and extends in a front-rear direction to thereby divide an inner space of the chamber body.

6. The wet duster according to claim 5, wherein the at least one flow guide wall is inclined with respect to the partition wall.

7. The wet duster according to claim 5, wherein the heating chamber is configured to guide steam between the partition wall and the at least one flow guide wall.

8. The wet duster according to claim 1, wherein the at least one flow guide wall has a first end and a second end, wherein the second end is connected to a side wall of the chamber body, wherein the at least one flow guide wall comprises a flow delay protrusion that protrudes from the first end, and wherein, in the state in which the duster is placed on the floor, (i) the first end is disposed closer to the floor than the second end, and (ii) an upper end of the flow delay protrusion is disposed farther from the floor than the second end.

9. The wet duster according to claim 1, wherein the heating chamber further comprises a partition wall that divides the chamber body into (i) a first chamber configured to heat water and (ii) a second chamber that is separate from the first chamber and configured to heat water independently of the first chamber.

10. The wet duster according to claim 9, wherein the steam generator is configured to provide a temperature inside the first chamber to be different from a temperature inside the second chamber.

11. The wet duster according to claim 9, wherein the steam generator is configured to provide a phase of moisture discharged from the first chamber to be different from a phase of moisture discharged from the second chamber.

12. The wet duster according to claim 1, wherein the steam generator comprises:

a heater disposed at a lower side of the heating chamber and configured to supply heat to the heating chamber;

a lower cover that is disposed at a lower side of the heater and covers the heater;

a sealer that is disposed at an upper side of the heating chamber and covers the upper side of the heating chamber; and an upper cover that is disposed at an upper side of the sealer and covers the sealer.

13. The wet duster according to claim 1, further comprising a diffuser comprising at least one nozzle, the diffuser being configured to supply steam discharged from the steam generator to the duster through the at least one nozzle.

14. The wet duster according to claim 13, wherein the diffuser further comprises:

a diffuser body that defines a diffusion flow path configured to guide steam; and a connection pipe disposed at the diffuser body and coupled to the moisture outlet of the steam generator.

15. The wet duster according to claim 14, wherein the diffuser body has an annular shape.

16. The wet duster according to claim 14, wherein the diffuser body has an arc shape.

17. The wet duster according to claim 1, wherein the heating chamber has a bottom surface that defines an exterior of the heating chamber, wherein the water inlet and the moisture outlet extend through the bottom surface of the heating chamber, and wherein the bottom surface of the heating chamber is inclined with respect to a bottom surface of the housing that is configured to face the floor.

18. A wet duster for a cleaner, comprising:

a housing comprising (i) a lower housing and (ii) an upper housing that covers the lower housing;

a water tank coupled to the housing and configured to store water;

at least one rotation cleaning unit disposed at a lower side of the housing and configured to couple to a duster; and a steam generator configured to heat water supplied from the water tank, wherein the steam generator comprises:

a heating chamber that defines a flow path configured to carry moisture therein, the heating chamber comprising (i) a chamber body and (ii) at least one flow guide wall protruding from an inside of the chamber body, a water inlet defined at the chamber body and configured to receive water from the water tank, and a moisture outlet defined at the chamber body and configured to discharge steam, and wherein the moisture outlet is disposed closer to the rotation cleaning unit than the water inlet and the at least one flow guide wall.

19. The wet duster according to claim 18, wherein the heating chamber has a bottom surface configured to contact water, wherein the at least one rotation cleaning unit has a disk shape, and wherein, in a state in which the duster is placed on a floor, the bottom surface of the heating chamber is inclined with respect to a surface of the at least one rotation cleaning unit by a predetermined angle.

20. The wet duster according to claim 19, wherein, in the state in which the duster is placed on the floor, a rear end of the bottom surface of the heating chamber is disposed higher than a front end of the bottom surface of the heating chamber, the rear end being located closer to the cleaner than the front end.

* * * * *